US011052433B2

(12) United States Patent
Hoshiba et al.

(10) Patent No.: US 11,052,433 B2
(45) Date of Patent: Jul. 6, 2021

(54) ULTRASONIC CLEANING EQUIPMENT AND ULTRASONIC CLEANING METHOD

(71) Applicant: NIPPON STEEL CORPORATION, Tokyo (JP)

(72) Inventors: Eri Hoshiba, Tokyo (JP); Hiromitsu Date, Tokyo (JP); Takumi Nishimoto, Tokyo (JP); Kenichi Uemura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 11 days.

(21) Appl. No.: 16/484,049

(22) PCT Filed: Mar. 16, 2018

(86) PCT No.: PCT/JP2018/010457

§ 371 (c)(1),
(2) Date: Aug. 6, 2019

(87) PCT Pub. No.: WO2018/169050

PCT Pub. Date: Sep. 20, 2018

(65) Prior Publication Data

US 2020/0047220 A1 Feb. 13, 2020

(30) Foreign Application Priority Data

Mar. 16, 2017 (JP) ..... JP2017-051006

(51) Int. Cl.
*B08B 3/12* (2006.01)
*C23G 3/02* (2006.01)
*G10K 11/20* (2006.01)

(52) U.S. Cl.
CPC ..... *B08B 3/12* (2013.01); *C23G 3/027* (2013.01); *G10K 11/205* (2013.01)

(58) Field of Classification Search
None
See application file for complete search history.

(56) References Cited

U.S. PATENT DOCUMENTS 6,822,372 B2 11/2004 Puskas
7,040,332 B2 5/2006 Boyd et al.
(Continued)

FOREIGN PATENT DOCUMENTS

JP 51-96252 U 8/1976
JP 61-194727 A 8/1986
(Continued)

OTHER PUBLICATIONS

JP51096252 to Yoshio, English translation, accessed on Jul. 2020. (Year: 1975).*

(Continued)

*Primary Examiner* — Eric W Golightly
*Assistant Examiner* — Arlyn I Rivera-Cordero
(74) *Attorney, Agent, or Firm* — Birch, Stewart, Kolasch & Birch, LLP

(57) ABSTRACT

An ultrasonic cleaning equipment (1) according to the present invention includes a treatment tank (10) that stores a cleaning liquid that cleans an object to be cleaned and in which the object to be cleaned is immersed; an ultrasonic application mechanism (20) that applies ultrasonic waves to the cleaning liquid retained in an interior of the treatment tank; and a curved surface member (30) that is located in a range defined by an angle of inclination from a perpendicular direction in an end portion of a vibrating surface of the ultrasonic application mechanism to an outside with respect to the vibrating surface and that is held on a wall surface and/or a bottom surface of the treatment tank.

19 Claims, 16 Drawing Sheets

(56) References Cited

U.S. PATENT DOCUMENTS

| | | | |
|---|---|---|---|
| 2004/0238000 | A1 | 12/2004 | Yeo et al. |
| 2012/0240956 | A1 | 9/2012 | Nishimoto et al. |
| 2013/0312785 | A1 | 11/2013 | Haibara et al. |

FOREIGN PATENT DOCUMENTS

| | | | |
|---|---|---|---|
| JP | 6-343933 | A | 12/1994 |
| JP | 11-188324 | A | 7/1999 |
| JP | 2001-358108 | A | 12/2001 |
| JP | 2012-143708 | A | 8/2012 |
| JP | 2014-140832 | A | 8/2014 |
| KR | 10-2015-0075070 | A | 7/2015 |
| WO | WO 2011/067955 | A1 | 6/2011 |

OTHER PUBLICATIONS

International Search Report for PCT/JP2018/010457 (PCT/ISA/210) dated Jun. 19, 2018, 6 pages.
Written Opinion of the International Searching Authority for PCT/JP2018/010457 (PCT/ISA/237) dated Jun. 19, 2018, 6 pages.
International Preliminary Report on Patentability and English translation of the Written Opinion of the International Searching Authority (forms PCT/IB/373, PCT/ISA/237 and PCT/IB/326), dated Sep. 26, 2019, for corresponding International Application No. PCT/JP2018/010457, 12 pages.
Japanese Office Action, dated Oct. 1, 2019, for Japanese Application No. 2019-506296, with an English translation, 3 pages.

* cited by examiner

1 : ULTRASONIC CLEANING EQUIPMENT

1 : ULTRASONIC CLEANING EQUIPMENT

ULTRASONIC CLEANING EQUIPMENT AND ULTRASONIC CLEANING METHOD

FIELD

The present invention relates to an ultrasonic cleaning equipment and an ultrasonic cleaning method.

BACKGROUND

In general, in the production processes of various metal bodies such as steel sheets and steel pipes, a cleaning treatment method in which metal bodies are cleaned by being successively immersed in a cleaning tank in which a chemical liquid, a rinse, or the like is retained is widely used in order to remove scale etc. generated on the surfaces of the metal bodies. Examples of a cleaning treatment apparatus that performs such a cleaning treatment method include a cleaning apparatus using a high-pressure air stream jet nozzle, an ultrasonic cleaning equipment using ultrasonic waves, etc.

As such an ultrasonic cleaning method using ultrasonic waves, for example, Patent Literature 1 below proposes a method in which an ultrasonic reflector is installed parallel to a surface of a vibrator in an ultrasonic cleaning tank in a position distant by $\lambda/4\cdot(2n-1)$ [$\lambda$: wavelength, n: an arbitrary integer] from the surface of the vibrator.

Further, Patent Literature 2 below proposes a technology in which microbubbles are added into a cleaning liquid and ultrasonic waves having two frequencies in the frequency range of more than or equal to 28.0 kHz and less than or equal to 1.0 MHz are applied, and thereby cleaning effect utilizing ultrasonic waves is further improved.

CITATION LIST

Patent Literature

Patent Literature 1: JP H6-343933A
Patent Literature 2: WO 2011/067955

SUMMARY

Technical Problem

However, the method proposed in Patent Literature 1 above is a method in which a reflector is installed parallel to a surface of a vibrator and ultrasonic waves are reflected by such a reflector; hence, when the surface of the reflector is a curved surface or has protrusions, the method has difficulty in reflecting ultrasonic waves effectively and reduces cleaning efficiency. Further, the reflector proposed in Patent Literature 1 is a flat plate; in this case, standing waves due to ultrasonic waves are generated, and a region with small ultrasonic intensity occurs. Consequently, cleaning unevenness occurs, and uniform cleaning cannot be performed. Further, in such a method, cleaning based on ultrasonic waves cannot be performed in a portion hidden from the surface of the vibrator, and cleaning based on ultrasonic waves is difficult to perform with good efficiency throughout the entire treatment tank.

In the technology proposed in Patent Literature 2 above, ultrasonic waves having two frequencies are used; however, matching between ultrasonic waves with different two frequencies is difficult, and the type of the object that can be cleaned and the cleaning area are limited.

Thus, the present invention has been made in view of the problem mentioned above, and an object of the present invention is to provide an ultrasonic cleaning equipment and an ultrasonic cleaning method by which ultrasonic waves can be propagated with better efficiency throughout the entirety of a treatment tank and an object to be cleaned can be cleaned with better efficiency regardless of the type of the object to be cleaned.

Solution to Problem

The present inventors conducted extensive studies to solve the issue mentioned above, and have obtained the findings that ultrasonic waves can be propagated with better efficiency throughout the entirety of a treatment tank in which a cleaning liquid is retained by installing a curved surface member having a prescribed shape in a prescribed position in the treatment tank, and an object to be cleaned can be cleaned with better efficiency regardless of the type of the object to be cleaned; thus, have completed the present invention, which is described in detail below.

The gist of the present invention completed on the basis of such findings is as follows.

[1] An ultrasonic cleaning equipment including: a treatment tank that stores a cleaning liquid that cleans an object to be cleaned and in which the object to be cleaned is immersed; an ultrasonic application mechanism that applies ultrasonic waves to the cleaning liquid retained in an interior of the treatment tank; and a curved surface member that is located in a range prescribed by a prescribed angle of inclination from a normal direction in an end portion of a vibrating surface of the ultrasonic application mechanism to an outside with respect to the vibrating surface and that is held on a wall surface and/or a bottom surface of the treatment tank. The curved surface member has a convex curved surface in which at least a convex curved part having a surface shape of a spherical surface or an aspherical surface exists and the convex curved part is in a state of protruding more on a side of the vibrating surface than a portion other than the convex curved part does, and the convex curved surface is held in a state of facing the vibrating surface in such a manner that at least part of first sound waves that are sound waves that are applied from the ultrasonic application mechanism and that have not experienced reflection arrive at the convex curved part of the convex curved surface.

[2] The ultrasonic cleaning equipment according to [1], in which a maximum height H of the convex curved part in the convex curved surface satisfies a relation of $\lambda/2<H$, where a wavelength of the ultrasonic wave is denoted by $\lambda$.

[3] The ultrasonic cleaning equipment according to [1] or [2], in which a magnitude of the angle of inclination is more than or equal to 0 degrees and less than or equal to 30 degrees.

[4] The ultrasonic cleaning equipment according to any one of [1] to [3], in which the convex curved part of the curved surface member has an area ratio of more than or equal to 30% to a total area of the curved surface member located in the range prescribed on the basis of the vibrating surface.

[5] The ultrasonic cleaning equipment according to any one of [1] to [4], in which the convex curved part of the curved surface member has an area ratio of more than or equal to 1% and less than or equal to 80% to a total surface area of the wall surface and/or the bottom surface of the treatment tank located in the range prescribed on the basis of the vibrating surface.

[6] The ultrasonic cleaning equipment according to any one of [1] to [5], in which the curved surface member, and the wall surface and/or the bottom surface on which the curved surface member is placed do not have a concave portion.

[7] The ultrasonic cleaning equipment according to any one of [1] to [6], including: a plurality of curved surface members that are arranged with prescribed spacings.

[8] The ultrasonic cleaning equipment according to [7], in which a separation distance L between adjacent ones of the plurality of curved surface members satisfies a relation of $3H<L$ for a maximum height H of the convex curved part of the curved surface member.

[9] The ultrasonic cleaning equipment according to any one of [1] to [8], in which a separation distance D between the vibrating surface and a position that gives a maximum height of the convex curved part in the convex curved surface in the curved surface member is more than or equal to 5 cm and less than or equal to 250 cm.

[10] The ultrasonic cleaning equipment according to any one of [1] to [9], in which the curved surface member is a curved surface member made of a material with an acoustic impedance of more than or equal to $1\times10^7$ [$kg\cdot m^{-2}\cdot sec^{-1}$] and less than or equal to $2\times10^8$ [$kg\cdot m^{-2}\cdot sec^{-1}$].

[11] The ultrasonic cleaning equipment according to any one of [1] to [10], further including: a dissolved gas control mechanism that controls the amount of dissolved gas in the cleaning liquid retained in the treatment tank.

[12] The ultrasonic cleaning equipment according to [11], in which the dissolved gas control mechanism makes control so that the amount of dissolved gas is 1% to 50% of the saturation amount of dissolved gas in the cleaning liquid.

[13] The ultrasonic cleaning equipment according to any one of [1] to [12], further including: a fine bubble supply mechanism that supplies fine bubbles each having a prescribed average air bubble diameter into the cleaning liquid retained in the treatment tank.

[14] The ultrasonic cleaning equipment according to [13], in which the fine bubble supply mechanism supplies fine bubbles each having an average air bubble diameter of 0.01 μm to 100 μm in such a manner that the total amount of air bubbles is $10^3$/mL to $10^{10}$/mL.

[15] The ultrasonic cleaning equipment according to [13] or [14], in which the fine bubble supply mechanism supplies the fine bubbles in such a manner that, in the cleaning liquid, a proportion of the number of fine bubbles each having an air bubble diameter less than or equal to a frequency resonance diameter that is a diameter resonating with a frequency of the ultrasonic wave is more than or equal to 70% of the number of all the fine bubbles existing in the cleaning liquid.

[16] The ultrasonic cleaning equipment according to any one of [1] to [15], in which the ultrasonic application mechanism selects a frequency of the ultrasonic wave from a frequency band of 20 kHz to 200 kHz.

[17] The ultrasonic cleaning equipment according to any one of [1] to [16], in which the ultrasonic application mechanism applies ultrasonic waves to the cleaning liquid while sweeping frequency in a range of ±0.1 kHz to ±10 kHz about a selected ultrasonic frequency.

[18] The ultrasonic cleaning equipment according to any one of [1] to [17], in which a reflector that reflects ultrasonic waves is further provided between the curved surface member and the wall surface or the bottom surface of the treatment tank on which the curved surface member is held.

[19] An ultrasonic cleaning method that cleans an object to be cleaned by using a treatment tank in which a cleaning liquid that cleans the object to be cleaned is put, in which an ultrasonic application mechanism that applies ultrasonic waves to the cleaning liquid is provided to the treatment tank, and a curved surface member is provided to a wall surface and/or a bottom surface of the treatment tank located in a range prescribed by a prescribed angle of inclination from a normal direction in an end portion of a vibrating surface of the ultrasonic application mechanism to an outside with respect to the vibrating surface, the ultrasonic cleaning method including: applying ultrasonic waves to the cleaning liquid retained in the treatment tank; and immersing the object to be cleaned in the cleaning liquid to which ultrasonic waves are applied. The curved surface member has a convex curved surface in which at least a convex curved part having a surface shape of a spherical surface or an aspherical surface exists and the convex curved part is in a state of protruding more on a side of the vibrating surface than a portion other than the convex curved part does, and the convex curved surface is held in a state of facing the vibrating surface in such a manner that at least part of first sound waves that are sound waves that are applied from the ultrasonic application mechanism and that have not experienced reflection arrive at the convex curved part of the convex curved surface.

Advantageous Effects of Invention

As described above, according to the present invention, ultrasonic waves can be propagated with better efficiency throughout the entirety of a treatment tank, and an object to be cleaned can be cleaned with better efficiency regardless of the type of the object to be cleaned.

DESCRIPTION OF EMBODIMENTS

Figure 1A:
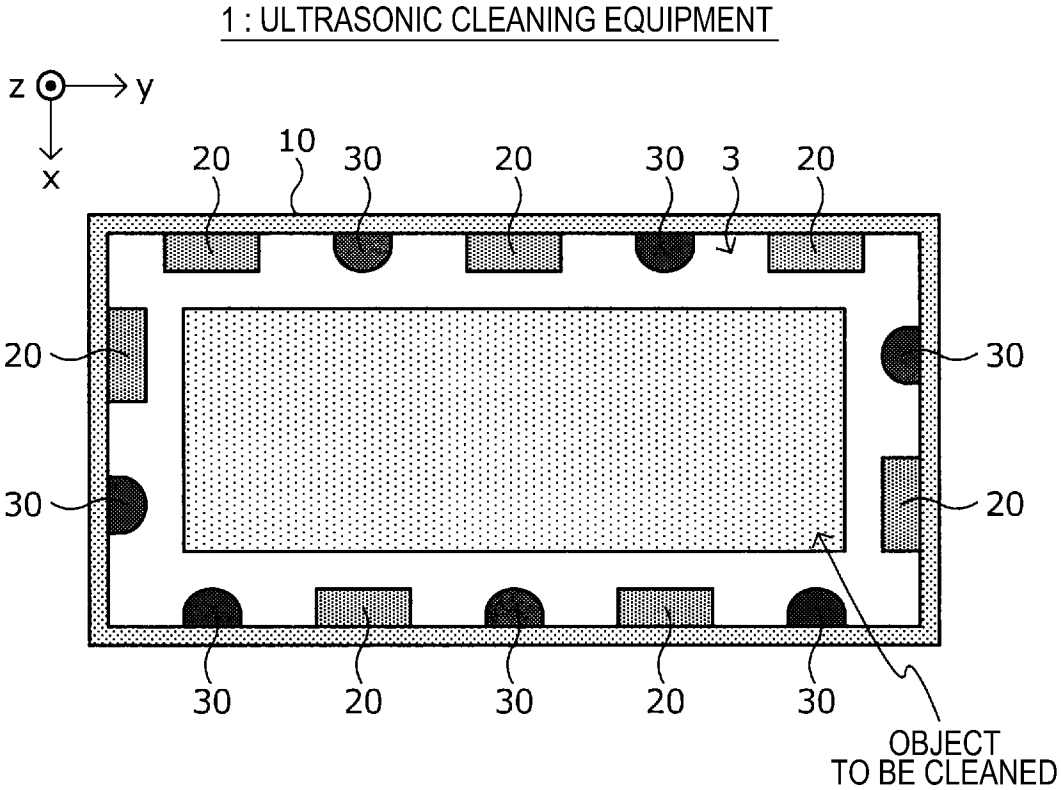
FIG. 1A is an explanatory diagram schematically showing an example of an overall configuration of an ultrasonic cleaning equipment according to an embodiment of the present invention.

Hereinafter, (a) preferred embodiment(s) of the present invention will be described in detail with reference to the appended drawings. Note that, in this specification and the appended drawings, structural elements that have substantially the same function and structure are denoted with the same reference numerals, and repeated explanation of these structural elements is omitted. Further, the sizes of members in the drawings are emphasized for easier description as appropriate, and do not show the actual dimensions and the ratios between members.

(Overall Configuration of Ultrasonic Cleaning Equipment)

First, an overall configuration of an ultrasonic cleaning equipment according to an embodiment of the present invention is briefly described with reference to FIG. 1A to FIG. 1D. FIG. 1A to FIG. 1D are explanatory diagrams schematically showing examples of the overall configuration of the ultrasonic cleaning equipment according to the present embodiment.

An ultrasonic cleaning equipment 1 according to the present embodiment is an equipment that cleans a surface of an object to be cleaned by using ultrasonic waves in addition to a cleaning liquid in combination. Such an ultrasonic cleaning equipment 1 can be used at the time of cleaning various metal bodies typified by steel materials and the like, various non-metal bodies typified by plastic resin members and the like, etc. For example, pickling treatment, degreasing treatment, and further cleaning treatment can be performed on, as objects to be cleaned, various metal bodies such as steel sheets, steel pipes, and steel wire materials by using the ultrasonic cleaning equipment 1 according to the present embodiment.

Here, pickling treatment is a treatment of removing oxide scale formed on a surface of a metal body, and degreasing treatment is a treatment of removing oil such as lubricant and processing oil used for processing treatment or the like. The pickling treatment and the degreasing treatment are pre-treatment performed before surface finish treatment (metal covering treatment, chemical conversion treatment, coating treatment, etc.) is performed on the metal body. Part of the ground metal may be dissolved by such pickling treatment. Further, such pickling treatment is used also for the dissolution of a metal body based on etching for improving the quality of surface finish. Degreasing treatment may be provided before pickling treatment; the degreasing capacity in the degreasing treatment may influence the removal of scale in the subsequent pickling treatment.

The ultrasonic cleaning equipment 1 according to the present embodiment described in detail below may be used for, as well as a cleaning process in a production line like that mentioned above, the cleaning of used pipes, tanks and apparatuses that require dirt removal regularly or irregularly, and the like.

Figure 1B:
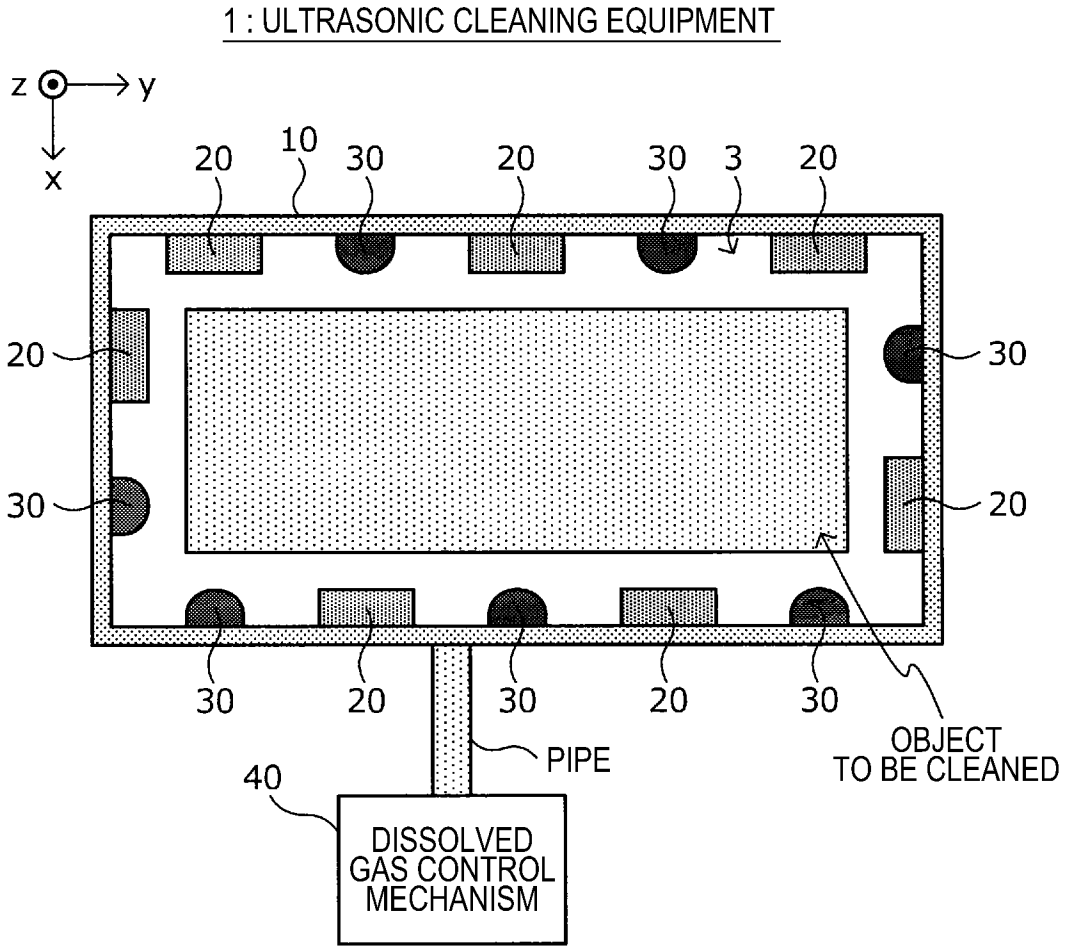
FIG. 1B is an explanatory diagram schematically showing an example of an overall configuration of an ultrasonic cleaning equipment according to the embodiment.
Figure 1C:
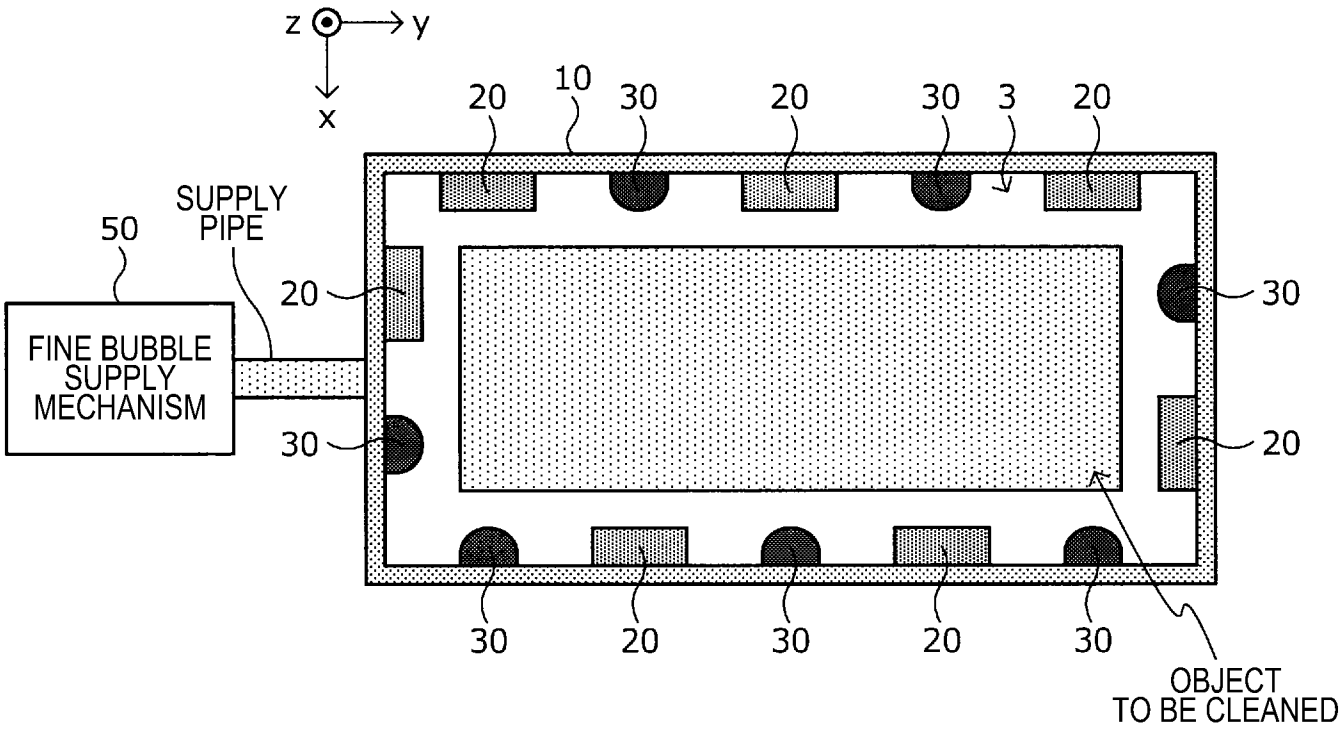
FIG. 1C is an explanatory diagram schematically showing an example of an overall configuration of an ultrasonic cleaning equipment according to the embodiment.
Figure 1D:
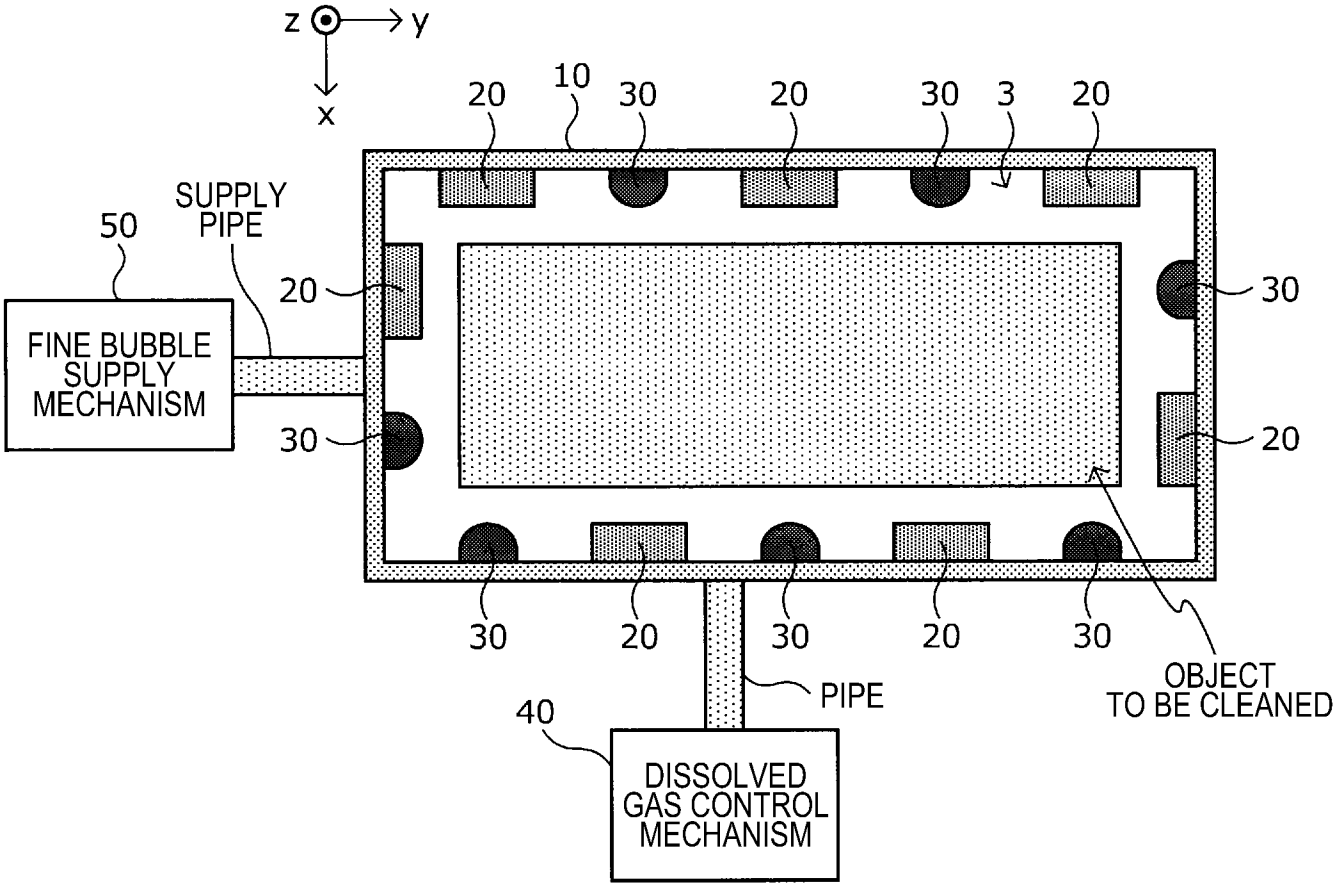
FIG. 1D is an explanatory diagram schematically showing an example of an overall configuration of an ultrasonic cleaning equipment according to the embodiment.

As illustrated in FIG. 1A, the ultrasonic cleaning equipment 1 according to the present embodiment is an equipment including at least a treatment tank 10, ultrasonic application mechanisms 20, and curved surface members 30. The ultrasonic cleaning equipment 1 according to the present embodiment may, as illustrated in FIG. 1B, further include a dissolved gas control mechanism 40 in addition to the configuration shown in FIG. 1A, and may, as illustrated in FIG. 1C, further include a fine bubble supply mechanism 50 in addition to the configuration shown in FIG. 1A. The ultrasonic cleaning equipment 1 according to the present embodiment may, as illustrated in FIG. 1D, further include the dissolved gas control mechanism 40 and the fine bubble supply mechanism 50 in addition to the configuration shown in FIG. 1A.

The configuration of each component in the ultrasonic cleaning equipment 1 according to the present embodiment will now be described in detail.

<Treatment Tank 10>

A cleaning liquid 3 used to clean an object to be cleaned and the object to be cleaned are put in the treatment tank 10. The kind of the cleaning liquid 3 retained in the treatment tank 10 is not particularly limited, and a known cleaning liquid may be used in accordance with the treatment performed on the object to be cleaned. Known particles or the like may be added to the cleaning liquid 3 for the purpose of further improvement in cleanability.

Here, the material used to form the treatment tank 10 according to the present embodiment is not particularly limited, and may be various metal materials such as iron, steel, and stainless steel sheets, may be various plastic resins such as fiber-reinforced plastics (FRP) and polypropylene (PP), or may be various bricks such as acid-resistant bricks. That is, as the treatment tank 10 included in the ultrasonic cleaning equipment 1 according to the present embodiment, treatment tanks formed of materials like those mentioned above may be newly prepared, or already existing treatment tanks in various production lines may be used.

The size of the treatment tank 10 is not particularly limited, either; even large-sized treatment tanks having various shapes, such as one having a depth from the surface of the liquid of approximately 1 to 2 m×a total length of approximately 3 to 25 m, can be used as the treatment tank 10 of the ultrasonic cleaning equipment 1 according to the present embodiment.

In the cleaning tank 10, it is preferable that the wall surface and/or the bottom surface on which curved surface members 30 described later are arranged not have a concave portion. Thereby, an event in which ultrasonic waves converge due to a concave portion and part of the ultrasonic waves cannot be utilized is prevented.

<Ultrasonic Application Mechanism 20>

The ultrasonic application mechanism 20 applies ultrasonic waves with a prescribed frequency to the cleaning liquid 3 and the object to be cleaned put in the treatment tank 10. The ultrasonic application mechanism 20 is not particularly limited, and a known mechanism, such as an ultrasonic vibrator connected to a not-illustrated ultrasonic oscillator, may be used. Although FIG. 1A to FIG. 1D show a case where the ultrasonic application mechanism 20 is provided on the wall surface of the treatment tank 10, the installation position of the ultrasonic application mechanism 20 on the treatment tank 10 is not particularly limited, either, and one or a plurality of ultrasonic vibrators may be installed on the wall surface or the bottom surface of the treatment tank 10, as appropriate. When conditions whereby ultrasonic waves are propagated uniformly in the entire treatment tank 10 are created, the balance between the oscillation loads of ultrasonic vibrators is uniform, and therefore interference does not occur between generated ultrasonic waves even when the number of ultrasonic vibrators is plural.

The frequency of the ultrasonic wave outputted from the ultrasonic application mechanism 20 is preferably 20 kHz to 200 kHz, for example. By the frequency of the ultrasonic wave being within the range mentioned above, scale existing on a surface of a metal body, such as a steel material, can be removed favorably. If the frequency of the ultrasonic wave is less than 20 kHz, ultrasonic propagation may be inhibited by air bubbles with large sizes generated from the surface of the object to be cleaned, and the effect of improving cleanability based on ultrasonic waves may be reduced. Further, if the frequency of the ultrasonic wave is more than 200 kHz, the straight travel ability of the ultrasonic wave at the time of cleaning the object to be cleaned is too strong, and the uniformity of cleaning may be reduced. Further, the removal of scale may be difficult depending on the equipment configuration of the ultrasonic cleaning equipment 1. The frequency of the ultrasonic wave outputted from the ultrasonic application mechanism 20 is preferably 20 kHz to 150 kHz, and more preferably 25 kHz to 100 kHz.

For the frequency of the applied ultrasonic wave, preferably an appropriate value is selected within the range mentioned above in accordance with the object to be cleaned, and ultrasonic waves with two or more frequencies may be applied depending on the kind of the object to be cleaned.

It is preferable for the ultrasonic application mechanism 20 to have a frequency sweep function that can apply an ultrasonic wave while sweeping frequency in a range of ±0.1 kHz to ±10 kHz about a selected ultrasonic frequency. The reason why it is preferable for the ultrasonic application mechanism 20 to have a frequency sweep function is described later.

<Curved Surface Member 30>

As described in detail below, the curved surface member 30 is a member having a curved surface that is convex toward the vibrating surface of the ultrasonic application mechanism 20, and is a member that reflects ultrasonic waves that have arrived at the curved surface member 30 in multiple directions. By providing such a curved surface member 30 on at least either one of the wall surface and the bottom surface in the treatment tank 10, ultrasonic waves generated from the vibrating surface of the ultrasonic application mechanism 20 can be propagated to the entire the treatment tank 10.

In more detail, the curved surface member 30 according to the present embodiment has at least a convex curved part having a surface shape of a spherical surface or an aspherical surface, and has a convex curved surface in a state where such a convex curved part protrudes more on the side of the vibrating surface of the ultrasonic application mechanism 20 than portions other than the convex curved part do.

Figure 2:
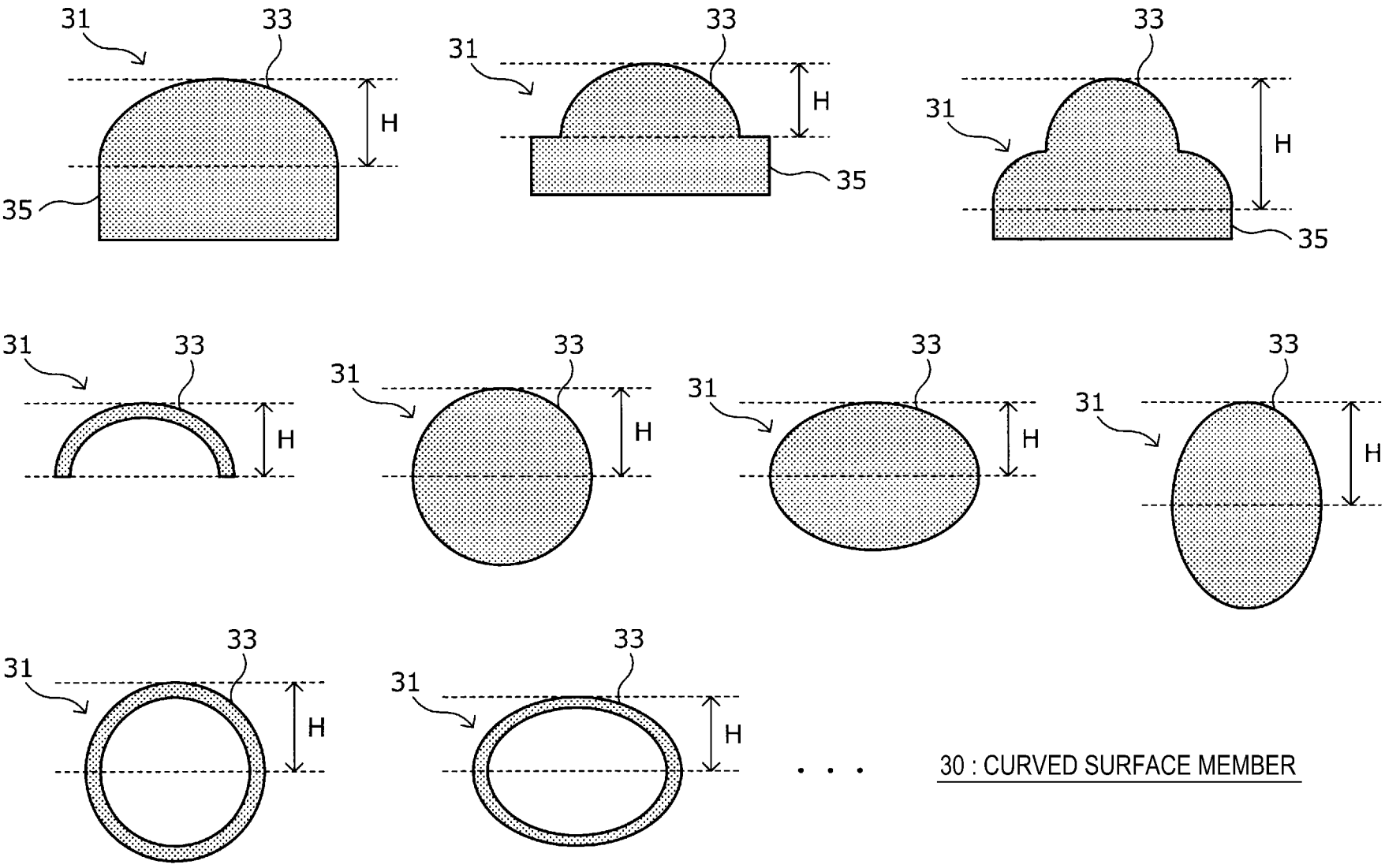
FIG. 2 is an explanatory diagram schematically showing examples of a curved surface member according to the embodiment.

FIG. 2 shows examples of the curved surface member 30 according to the present embodiment. FIG. 2 shows the shapes of curved surface members 30 according to the present embodiment as viewed from the upper side of the z-axis in the coordinate axes shown in FIG. 1A to FIG. 1D.

As shown in FIG. 2 individually, the curved surface member 30 according to the present embodiment has at least a convex curved surface 31, and such a convex curved surface 31 has at least a convex curved part 33 having a surface shape of a spherical surface or an aspherical surface. In the ultrasonic cleaning equipment 1 according to the present embodiment, the convex curved surface 31 having such a convex curved part 33 of the curved surface member 30 protrudes on the side of the vibrating surface of the ultrasonic application mechanism 20, and is held in a state of facing such a vibrating surface.

The curved surface member 30 according to the present embodiment may have a non-convex curved portion 35 that is a portion other than the convex curved part 33 as shown in the upper portion of FIG. 2, or may be formed only of the convex curved surface 31 as shown in the middle portion and the lower portion of FIG. 2.

Further, the curved surface member 30 according to the present embodiment may be a solid columnar body as shown in the upper portion and the middle portion of FIG. 2, or may be a hollow cylindrical body as shown in the lower portion of FIG. 2. In the case where the curved surface member 30 is hollow, various gases such as air may exist or various liquids such as the cleaning liquid 3 retained in the treatment tank 10 may exist in the space of the curved surface member 30 in the state of being mounted in the treatment tank 10.

By the curved surface member 30 having a convex curved surface 31 like that mentioned above, ultrasonic waves are reflected in multiple directions, and uniform ultrasonic propagation with no bias is achieved; thus, interference between ultrasonic waves can be suppressed. Consequently, ultrasonic waves can diffuse three-dimensionally in all directions in the cleaning tank 10, and uniform cleaning without unevenness can be performed. That is, ultrasonic waves arrive at the object to be cleaned from all angles, and the surface of the object to be cleaned is cleaned uniformly. Here, if the curved surface member 30 includes a concave portion, ultrasonic waves are reflected at the concave portion and thus converge, and ultrasonic waves cannot be effectively reflected to the entire treatment tank 10. Further, even in the case where a convex portion is provided, if the convex portion is not a curved surface but a flat surface, ultrasonic waves can be reflected only in one direction, and ultrasonic waves cannot be effectively reflected to the entire treatment tank 10.

The shapes of the curved surface members 30 shown in FIG. 2 are only examples, and the shape of the curved surface member 30 according to the present embodiment is not limited to the shapes shown in FIG. 2. However, in a member having wavelike concavities and convexities, the concave portion converges ultrasonic waves, and hence it may be difficult to diffuse ultrasonic waves uniformly; thus, this is not included in the curved surface member 30 according to the present embodiment.

Here, in the case where the curved surface member 30 has the convex curved part 33 and the non-convex curved portion 35, the maximum height H of the convex curved part 33 in a convex curved surface 31 like that shown in each figure of FIG. 2 is a height prescribed with, as a standard, the position of the connection portion between the convex curved part 33 and the non-convex curved portion 35. Further, in the case where the curved surface member 30 has only the convex curved part 33, the maximum height H is a height corresponding to the radius, a length of ½ of the major axis diameter, a length of ½ of the minor axis diameter, or the like of the curved surface member 30. When the wavelength of the ultrasonic wave applied by the ultrasonic application mechanism 20 is denoted by λ, the maximum height H of such a convex curved part 33 is preferably a height satisfying the relation of $\lambda/2<H$. When the maximum height H of the convex curved part 33 is set larger than a half wavelength of the ultrasonic wave, ultrasonic waves that have arrived at the curved surface of the convex curved part 33 can be totally reflected at some places of the curved surface. On the other hand, the upper limit of the maximum height H of the convex curved part 33 is not particularly prescribed, but is preferably set in accordance with the distance between the wall surface of the treatment tank 10 and the object to be cleaned, for example, set to less than or equal to 500 mm. The maximum height H of the convex curved part 33 is more preferably more than or equal to 10 mm and less than or equal to 300 mm.

The dimensions (the maximum width W, etc.) of the curved surface member 30 other than the maximum height mentioned above may be set in accordance with the area ratio of convex curved parts 33 to the total area of the wall surface etc. of the treatment tank 10 described later and the number of curved surface members 30, as appropriate.

The curved surface member 30 having a shape like one shown in FIG. 2 is preferably formed using a material that reflects ultrasonic waves, for example. Examples of such a material include a material with an acoustic impedance (specific acoustic impedance) of more than or equal to $1\times10^7$ [$kg\cdot m^{-2}\cdot sec^{-1}$] and less than or equal to $2\times10^8$ [$kg\cdot m^{-2}\cdot sec^{-1}$]. Ultrasonic waves can be reflected with good efficiency by using a material with an acoustic impedance of more than or equal to $1\times10^7$ [$kg\cdot m^{-2}\cdot sec^{-1}$] and less than or equal to $2\times10^8$ [$kg\cdot m^{-2}\cdot sec^{-1}$].

Examples of the material with an acoustic impedance of more than or equal to $1\times10^7$ [$kg\cdot m^{-2}\cdot sec^{-1}$] and less than or equal to $2\times10^8$ [$kg\cdot m^{-2}\cdot sec^{-1}$] include various metals, various metal oxides, various ceramics including non-oxide ceramics, and the like. Specific examples of such a material include steel (specific acoustic impedance [$kg\cdot m^{-2}\cdot sec^{-1}$]: $4.70\times10^7$; hereinafter, the numerical value in the brackets similarly represents the value of the specific acoustic impedance), iron ($3.97\times10^7$), stainless steel (SUS, $3.97\times10^7$), titanium ($2.73\times10^7$), zinc ($3.00\times10^7$), nickel ($5.35\times10^7$), aluminum ($1.38\times10^7$), tungsten ($1.03\times10^8$), glass ($1.32\times10^7$), quartz glass ($1.27\times10^7$), glass lining ($1.67\times10^7$), alumina (aluminum oxide, $3.84\times10^7$), zirconia (zirconium oxide, $3.91\times10^7$), silicon nitride (SiN, $3.15\times10^7$), silicon carbide (SiC, $3.92\times10^7$), tungsten carbide (WC, $9.18\times10^7$), and the like. The material used for the formation of the curved surface member 30 according to the present embodiment may be selected in accordance with the liquidity of the cleaning liquid 3 retained in the treatment tank 10 and the strength etc. required of the curved surface member 30, as appropriate; however, various metals or metal oxides having acoustic impedances like those mentioned above are preferably used.

Figure 3:
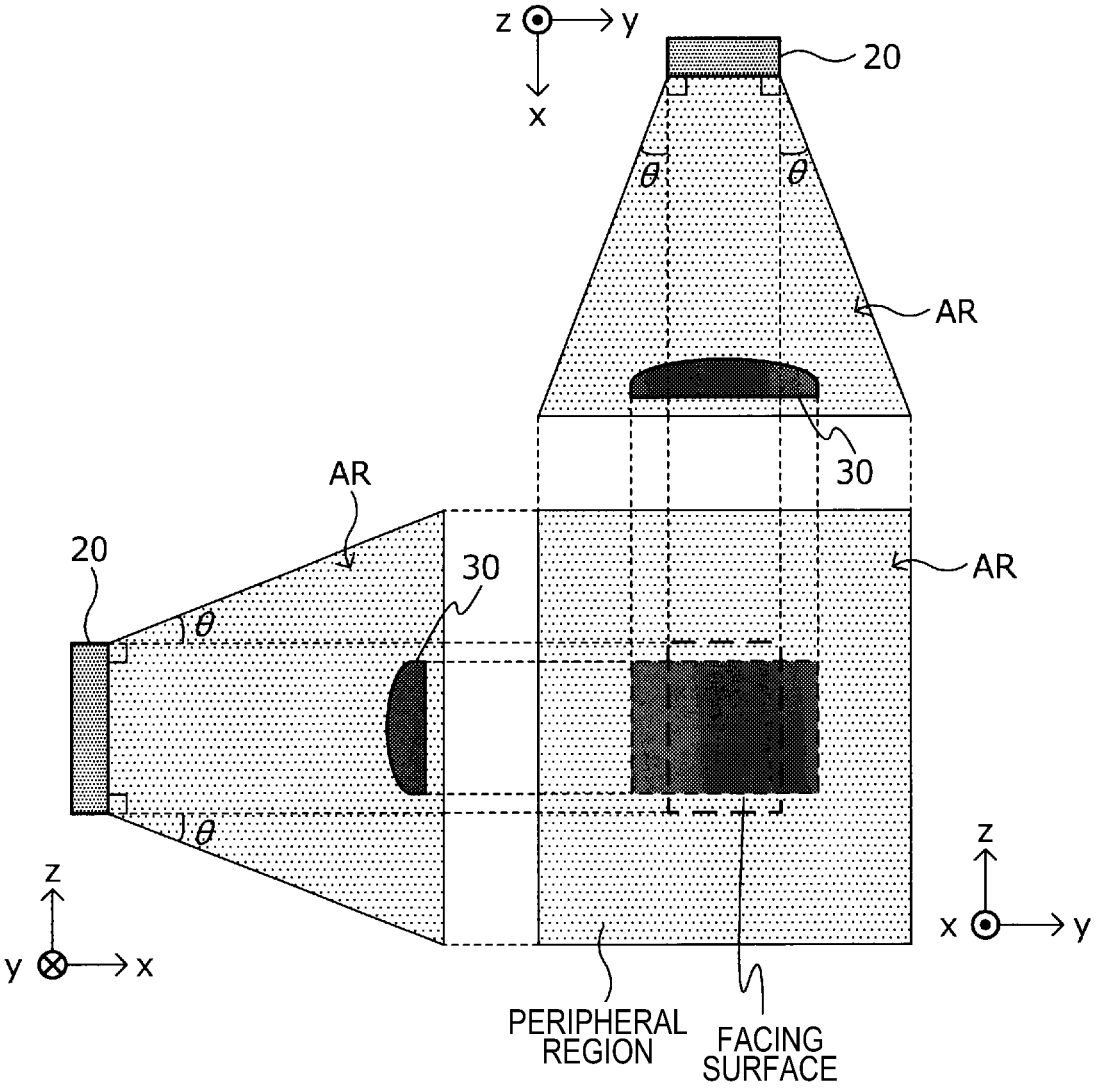
FIG. 3 is an explanatory diagram for describing a curved surface member according to the embodiment.

As schematically shown in FIG. 3, such a curved surface member 30 is located in a range prescribed by a prescribed angle of inclination θ from the normal direction in an end portion of the vibrating surface of the ultrasonic application mechanism 20 to the outside with respect to such a vibrating surface, and is held on the wall surface and/or the bottom surface of the treatment tank 10. In the following, the range prescribed by the vibrating surface of the ultrasonic application mechanism 20 and the prescribed angle of inclination θ is referred to as a vibrator effective range AR. As is clear from FIG. 3, the vibrator effective range AR is a range prescribed between a flat surface region prescribed by a facing surface that faces the vibrating surface of the ultrasonic application mechanism 20 at a prescribed separation distance and a peripheral region that is located on the same flat surface as such a facing surface and that is in contact with the facing surface, and the vibrating surface.

By the curved surface member 30 being held in the vibrator effective range AR, ultrasonic waves generated by the vibrating surface of the ultrasonic application mechanism 20 can be reflected in multiple directions with good efficiency, and ultrasonic waves can be propagated uniformly to the entire treatment tank 10. The installation direction of the curved surface member 30 is not limited to the example shown in FIG. 3; it is important that the convex curved surface 31 of the curved surface member 30 be installed in a state of facing the vibrating surface of the ultrasonic application mechanism 20, and the convex curved surface 31 may not be installed so as to be directed in front of the vibrating surface. The curved surface member 30 may be installed such that the long axis direction of the curved surface member 30 having a cross-sectional shape like one shown in FIG. 2 etc. is substantially parallel to the y-axis direction in the drawing, may be installed such that the long axis direction of the curved surface member 30 is substantially parallel to the z-axis direction in the drawing, or may be installed such that the long axis direction of the curved surface member 30 has a prescribed angle with the y-axis direction or the z-axis direction in the drawing.

Although in FIG. 3 the number of curved surface members 30 installed in the vibrator effective range AR is only one, it goes without saying that the number of curved surface members 30 installed in the vibrator effective range AR may be two or more, and curved surface members 30 may be set in accordance with the size etc. of the treatment tank 10, as appropriate. In the case where the vibrating surfaces of a plurality of ultrasonic application mechanisms 20 exist and a curved surface member 30 exists in a range in which the vibrator effective ranges AR of ultrasonic application mechanisms 20 overlap with each other, the curved surface member 30 existing in such a range functions as a reflection member effective to the vibrating surfaces of these ultrasonic application mechanisms 20. Further, there may be a curved surface member 30 not installed in the vibrator effective range AR. The number of curved surface members 30 may be set in accordance with, for example, the dimensions of the convex curved part 33 and the area ratio of convex curved parts 33 to the total area of the wall surface etc. of the treatment tank 10 described later, as appropriate.

Here, the magnitude of the angle of inclination θ in FIG. 3 is preferably more than or equal to 0 degrees and less than or equal to 30 degrees. Ultrasonic waves are waves having straight travel ability, and therefore strongly propagate to a surface directed in front of the vibrating surface and parts around such a surface. In the present embodiment, a sound wave that is derived from an ultrasonic wave oscillated from the surface of the vibrator and that has not experienced reflection until it arrives at the wall surface, the bottom surface, and/or the surface of the water is defined as a first sound wave. By setting the magnitude of the angle of inclination θ that prescribes the vibrator effective range AR to more than or equal to 0 degrees and less than or equal to 30 degrees and installing one or a plurality of curved surface members 30 in such a range AR, strong first sound waves can be reflected in multiple directions with better efficiency, and ultrasonic waves can be propagated uniformly in the entire treatment tank 10. That is, in the present embodiment, when an object to be cleaned does not exist in the treatment tank 10, the curved surface member 30 preferably exists in the range directed in front of the vibrating surface of the ultrasonic application mechanism 20 (θ=0 degrees) to the range of θ=30 degrees. On the other hand, if the magnitude of the angle of inclination θ is more than 30 degrees, at least part of first sound waves, which are sound waves that are applied from the ultrasonic application mechanism 20 and that have not experienced reflection, are less likely to arrive; thus, this is not preferable. The magnitude of the angle of inclination θ is more preferably more than or equal to 0 degrees and less than or equal to 25 degrees.

Figure 4A:
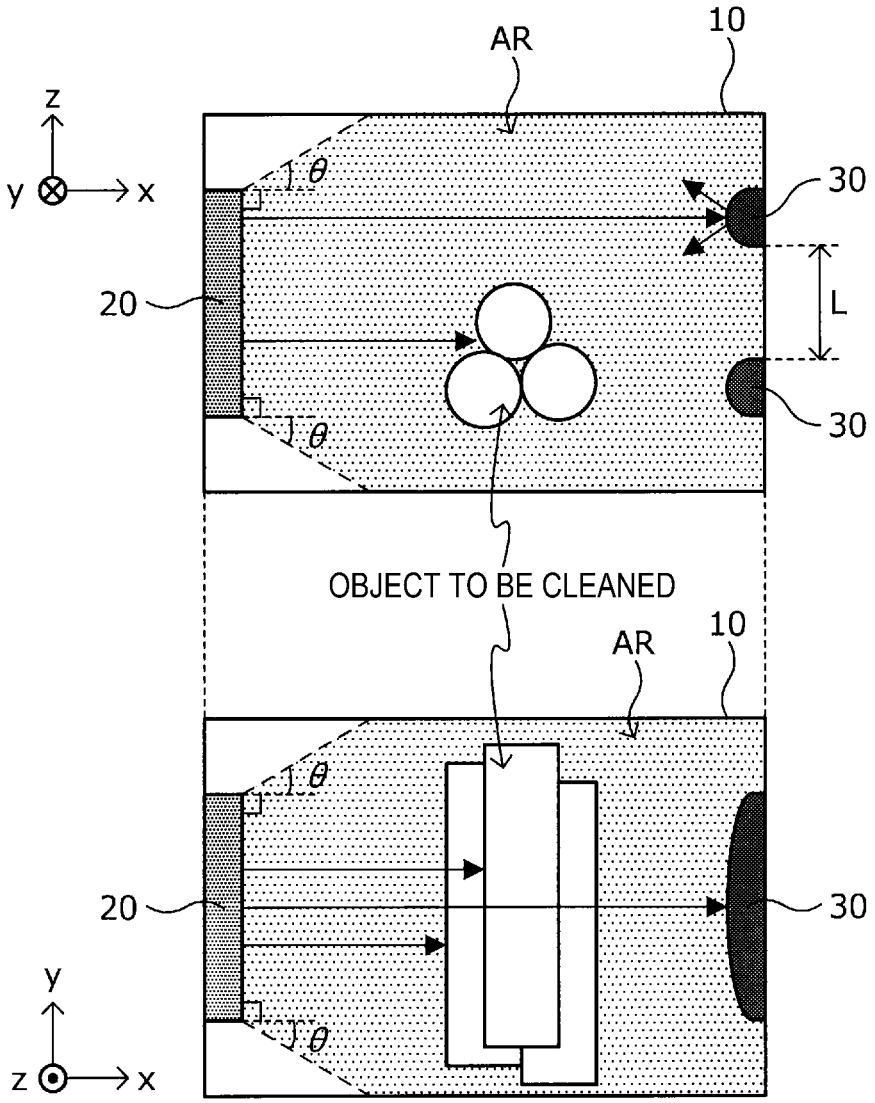
FIG. 4A is an explanatory diagram for describing a curved surface member according to the embodiment.
Figure 4B:
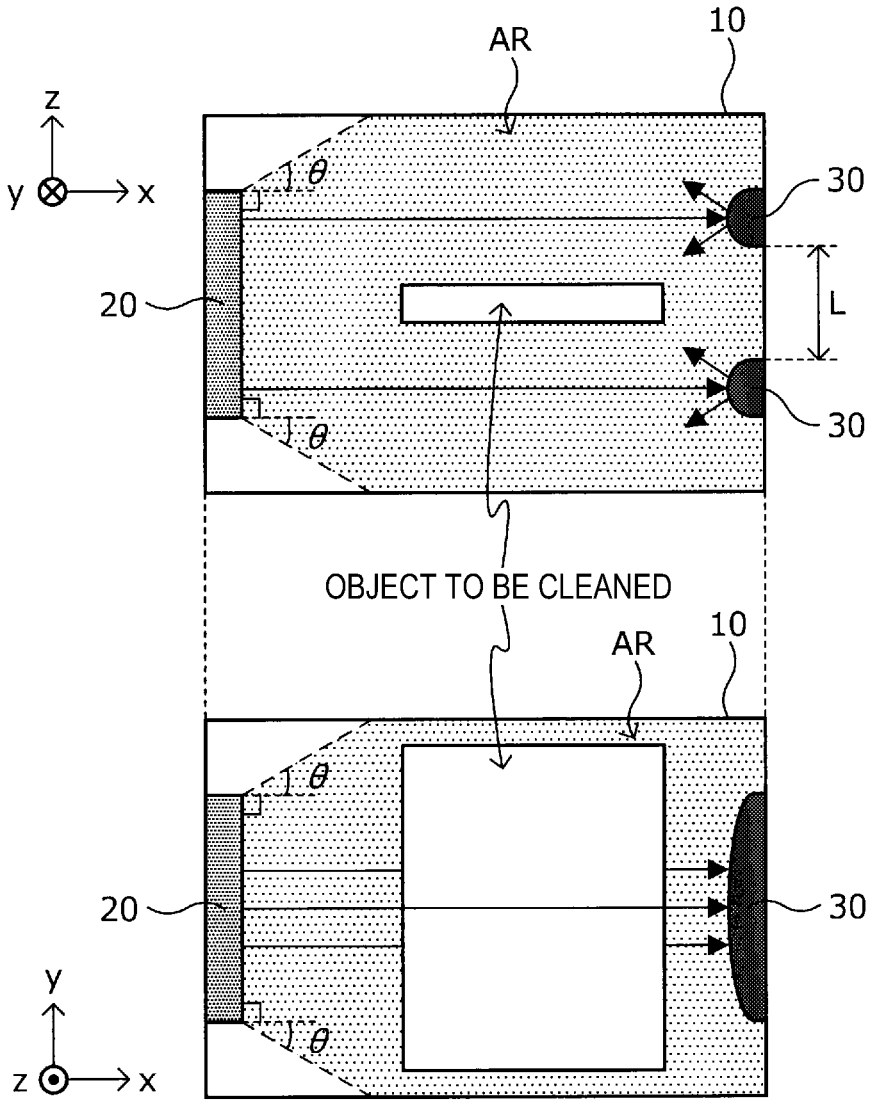
FIG. 4B is an explanatory diagram for describing a curved surface member according to the embodiment.
Figure 4C:
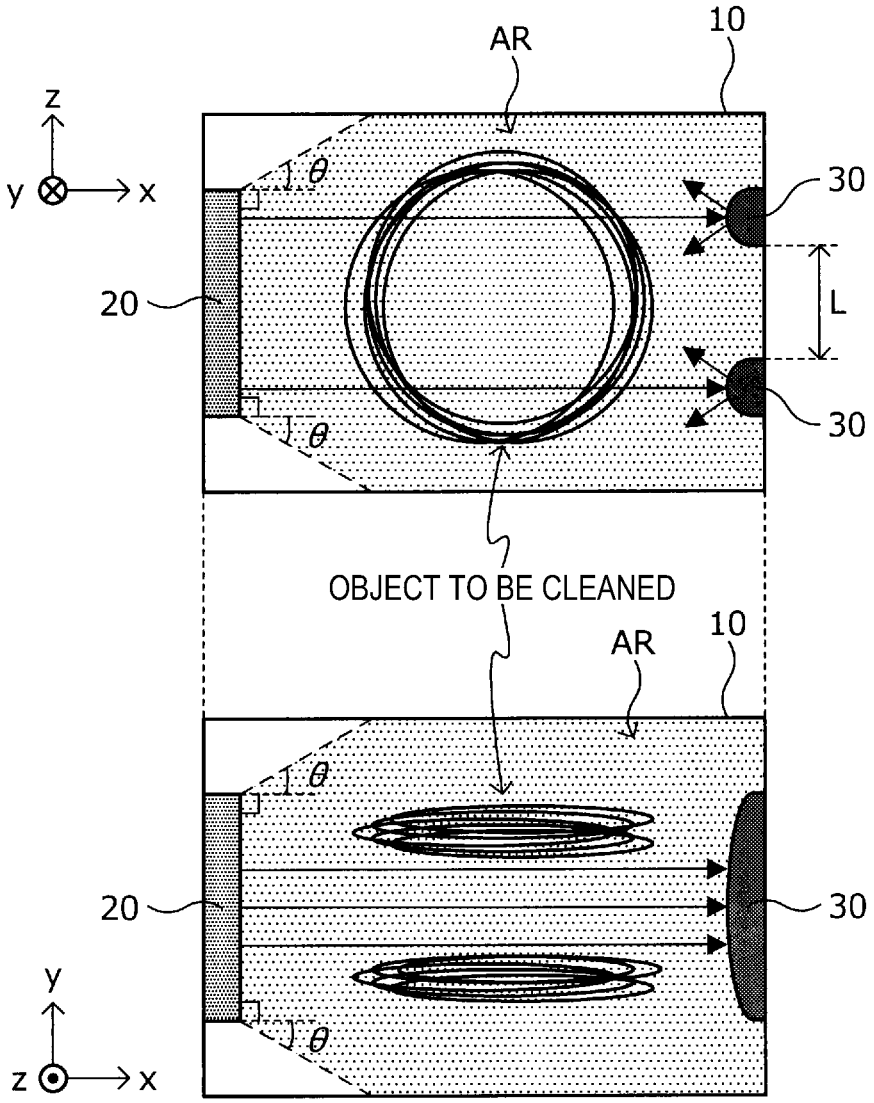
FIG. 4C is an explanatory diagram for describing a curved surface member according to the embodiment.

In the ultrasonic cleaning equipment 1 according to the present embodiment, as schematically shown in FIG. 4A to FIG. 4C, it is important that the convex curved surface 31 be held in a state of facing the vibrating surface in such a manner that at least part of first sound waves, which are sound waves that are applied from the ultrasonic application mechanism 20 and that have not experienced reflection, arrive at the convex curved part 33 of the convex curved surface 31. That is, since ultrasonic waves are waves having straight travel ability, it is important that the curved surface member 30 be installed in view of the immersion state of the object to be cleaned so that at least part of the first sound waves arrive at the convex curved part 33 of the curved surface member 30 even in a state where the object to be cleaned is immersed in the treatment tank 10. Whether first sound waves have arrived at the convex curved part 33 of the convex curved surface 31 of the curved surface member 30 or not can be assessed by whether or not, when ultrasonic waves are applied in a state where the object to be cleaned does not exist in the treatment tank 10, a change occurs in ultrasonic intensity measured in a position of the convex curved part 33 between when a shield member that blocks ultrasonic propagation is provided between the curved surface member 30 and the vibrating surface of the ultrasonic application mechanism 20 and when it is not provided.

For example, in the case where the object to be cleaned is a tubular body such as a steel pipe as shown in FIG. 4A, it is preferable that the installation positions of curved surface members 30 be determined such that at least part of the first sound waves arrive at a convex curved part 33 even when a prescribed amount of tubular bodies are immersed.

Also in the case where, for example, the object to be cleaned is a plate-like body such as a steel sheet as shown in FIG. 4B, it is preferable that the installation positions of curved surface members 30 be determined in accordance with the immersion position of the plate-like body so that at least part of the first sound waves arrive at a convex curved part 33. Similarly, in the case where, for example as shown in FIG. 4C, the object to be cleaned is a coil-like body in which a steel wire material or the like is wound, it is preferable that the installation positions of curved surface members 30 be determined in accordance with the immersion position of the coil-like wire material so that at least part of the first sound waves arrive at a convex curved part 33.

For the installation state of the curved surface member 30, in the case where a plurality of curved surface members 30 are arranged, the curved surface members 30 are preferably arranged with prescribed spacings. By a prescribed spacing thus existing between curved surface members 30, an event in which, when first sound waves are reflected and diffused on curved surface members 30, reflected waves converge between curved surface members 30 is prevented.

More specifically, it is preferable that the separation distance L between curved surface members 30 shown in FIG. 4A, FIG. 4B, and FIG. 4C satisfy the relation of $3H<L$ for the maximum height H of the convex curved part 33 of the curved surface member 30 shown in FIG. 2. If the separation distance L is less than or equal to three times the maximum height H mentioned above, the space between curved surface members 30 is likely to act as a concave portion, and sound waves that have arrived as first sound waves are not reflected to the treatment tank 10 but converge, and tend to be attenuated. On the other hand, when there is a certain separation distance L between curved surface members 30 larger than three times the maximum height H mentioned above, ultrasonic waves can be effectively reflected to the entire treatment tank 10 without attenuation. The separation distance L is preferably more than or equal to five times the maximum height H, and more preferably more than or equal to seven times. The specific separation distance L is not particularly limited; for example, may be more than or equal to 0.1 m, and preferably more than or equal to 0.2 m. On the other hand, the upper limit of the separation distance L is not particularly prescribed, but is preferably set in accordance with the area of the vibrating surface or the convex curved part, for example, set to less than or equal to 1.5 m.

The minimum distance between adjacent curved surface members 30 is taken as the separation distance L described above. In the case where the shapes of adjacent curved surface members 30 are different, the largest value among the maximum heights of the convex curved parts 33 of the curved surface members 30 is taken as the maximum height H.

For the installation state of a curved surface member 30 like one shown in FIG. 3 to FIG. 4C, more specifically it is preferable that the curved surface member 30 be installed such that the convex curved part 33 of the curved surface member 30 has an area ratio of more than or equal to 30% to the total surface area of the curved surface member 30 located in the vibrator effective range AR prescribed on the basis of the vibrating surface. By the area ratio of the convex curved part 33 to the total surface area of the curved surface member 30 being more than or equal to 30%, ultrasonic waves can be reflected more effectively, and ultrasonic waves can be propagated more uniformly in the entire treatment tank 10. Such an area ratio is preferably as large as possible; thus, the upper limit value thereof is not prescribed, and the area ratio may be 100%. The area ratio of the convex curved part 33 to the total surface area of the curved surface member 30 is more preferably more than or equal to 50%.

It is preferable that the convex curved parts 33 of curved surface members 30 have an area ratio of more than or equal to 1% and less than or equal to 80% to the total area of the wall surface and/or the bottom surface of the treatment tank 10 located in the vibrator effective range AR prescribed on the basis of the vibrating surface. Here, the area of the convex curved parts 33 refers to the area of the convex curved parts 33 facing the vibrating surface of the ultrasonic application mechanism 20. In other words, the area of the range that first sound waves can arrive at constitutes the area of the convex curved parts 33. For example, in the case where the curved surface member 30 is a pipe-like body, the area of the curved surfaces corresponding to semicircles is the area of the convex curved parts 33 that are taken into account. By the area ratio of the convex curved parts 33 to the total area of the wall surface etc. of the treatment tank 10 being within the range mentioned above, ultrasonic waves that have arrived at the convex curved parts 33 of the curved surface members 30 can be effectively diffused, and ultrasonic waves can be propagated more uniformly throughout the entire treatment tank 10. If the area ratio to the total area of the wall surface etc. of the treatment tank 10 is less than 1%, the effect of ultrasonic diffusion based on the curved surface member 30 is extremely lacking. On the other hand, if the area ratio to the total area of the wall surface etc. of the treatment tank 10 is more than 80%, a concave portion is created depending on the reflection directions of ultrasonic waves, and there is a case where ultrasonic waves cannot be diffused with good efficiency. The area ratio to the total area of the wall surface etc. of the treatment tank 10 is more preferably more than or equal to 3% and less than or equal to 80%, and still more preferably more than or equal to 10% and less than or equal to 80%. After the area ratio mentioned above is set in order to propagate ultrasonic waves more uniformly throughout the entire treatment tank 10, the dimensions and the number of curved surface members 30 may be set in accordance with the area ratio; thereby, uniform ultrasonic propagation can be achieved more reliably.

Figure 5:
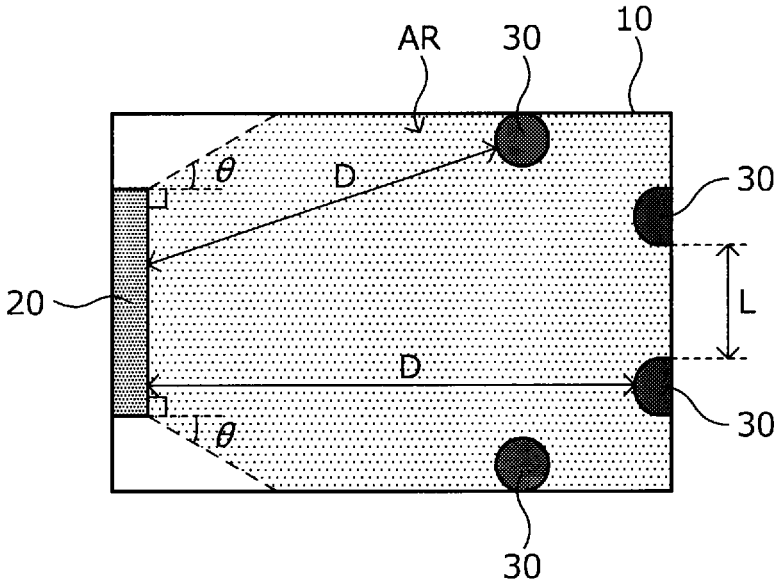
FIG. 5 is an explanatory diagram for describing a curved surface member according to the embodiment.

It is preferable that a separation distance D like that schematically shown in FIG. 5 between the vibrating surface of the ultrasonic application mechanism 20 and a position that gives the maximum height of the convex curved part 33 in the convex curved surface 31 in the curved surface member 30 be more than or equal to 5 cm and less than or equal to 250 cm. By the separation distance D being more than or equal to 5 cm and less than or equal to 250 cm, ultrasonic waves can be diffused more effectively. If the separation distance is less than 5 cm, ultrasonic waves reflected by the curved surface member 30 are strong and the vibrating surface of the ultrasonic application mechanism 20 may be damaged, or reflected ultrasonic waves may interfere with each other and propagation ability may be reduced; thus, this is not preferable. Further, if the separation distance D is more than 250 cm, ultrasonic waves themselves are gradually attenuated, and it may be difficult to enjoy reflection effect based on the curved surface member 30; thus, this is not preferable. The separation distance D is more preferably more than or equal to 10 cm and less than or equal to 200 cm.

Hereinabove, the curved surface member 30 according to the present embodiment is described in detail with reference to FIG. 2 to FIG. 5.

<Dissolved Gas Control Mechanism 40>

Next, returning to FIG. 1B and FIG. 1D again, the dissolved gas control mechanism 40, which the ultrasonic cleaning equipment 1 according to the present embodiment preferably includes, is described in detail.

The dissolved gas control mechanism 40 controls the amount of dissolved gas in the cleaning liquid 3 retained in the treatment tank 10 to a value in an appropriate range.

In the ultrasonic cleaning equipment 1 according to the present embodiment, it is preferable that the amount of dissolved gas in the cleaning liquid 3 be controlled to an appropriate value in order to achieve both more uniform ultrasonic propagation and higher cleanability. An appropriate amount of dissolved gas in such a cleaning liquid 3 is preferably more than or equal to 1% and less than or equal to 50% of the saturation amount of dissolved gas in the cleaning liquid 3. If the amount of dissolved gas is less than 1% of the saturation amount of dissolved gas, cavitation generation based on ultrasonic waves does not occur, and the ability of improving cleanability based on ultrasonic waves (the ability of improving surface treatability) cannot be exhibited; thus, this is not preferable. On the other hand, if the amount of dissolved gas is more than 50% of the saturation amount of dissolved gas, ultrasonic propagation is inhibited by the dissolved gas, and uniform ultrasonic propagation to the entire treatment tank 10 is inhibited; thus, this is not preferable. The amount of dissolved gas in the cleaning liquid 3 is preferably more than or equal to 5% and less than or equal to 40% of the saturation amount of dissolved gas in the cleaning liquid 3.

Here, when the temperature of the cleaning liquid 3 changes, the saturation amount of dissolved gas of the cleaning liquid 3 changes. Further, a difference in the molecular momentum of the liquid that forms the cleaning liquid 3 (for example, the molecular momentum of water), which difference is derived from a temperature change of the cleaning liquid 3, influences propagation ability. Specifically, when the temperature is low, the molecular momentum of the liquid that forms the cleaning liquid 3 is small; thus, it is easy to propagate ultrasonic waves, and the saturation amount of dissolved gas of the cleaning liquid 3 is high. Therefore, the temperature of the cleaning liquid 3 is preferably controlled so that a desired amount of dissolved gas within the range mentioned above can be achieved, as appropriate. The temperature of the cleaning liquid 3 is, for example, preferably approximately 20° C. to 85° C., depending on the specific content of treatment performed using the cleaning liquid 3.

Specifically, the amount of dissolved gas in the cleaning liquid 3 is, for example, preferably more than or equal to 0.1 ppm and less than or equal to 11.6 ppm, and more preferably more than or equal to 1.0 ppm and less than or equal to 11.0 ppm. Thus, the dissolved gas control mechanism 40 controls the temperature of the cleaning liquid 3 and the amount of dissolved gas in the cleaning liquid 3 so that the amount of dissolved gas in the cleaning liquid 3 retained in the treatment tank 10 is a value in a range like that mentioned above.

For the method for controlling the amount of dissolved gas, there are various methods such as vacuum deaeration and deaeration using chemicals, and a method may be selected as appropriate. Further, the amount of dissolved gas in the cleaning liquid 3 can be measured by a diaphragm electrode method and a known device such as an optical dissolved oxygen meter.

Here, the dissolved gas in the aqueous solution is mainly oxygen, nitrogen, carbon dioxide, helium, and argon, and oxygen and nitrogen account for most of the dissolved gas although the dissolved gas is influenced by the temperature and the components of the aqueous solution.

<Fine Bubble Supply Mechanism 50>

Next, returning to FIG. 1C and FIG. 1D again, the fine bubble supply mechanism 50, which the ultrasonic cleaning equipment 1 according to the present embodiment preferably includes, is described in detail.

The fine bubble supply mechanism 50 supplies, into the cleaning liquid 3 retained in the treatment tank 10 via a supply pipe, fine bubbles each having an air bubble diameter (average air bubble diameter) in accordance with the frequency of the ultrasonic wave applied from the ultrasonic application mechanism 20. The fine bubble refers to a fine air bubble with an average air bubble diameter of less than or equal to 100 μm. Among such fine bubbles, a fine bubble with an average air bubble diameter of micrometer-order size may be referred to as a microbubble, and a fine bubble with an average air bubble diameter of nanometer-order size may be referred to as a nanobubble. The fine bubble improves the efficiency of ultrasonic propagation to the object to be cleaned, and improves cleanability as a nucleus of ultrasonic cavitation.

The average air bubble diameter of the fine bubble supplied into the cleaning liquid is preferably 0.01 μm to 100 μm. Here, the average air bubble diameter refers to a diameter at which the number of samples is at the maximum in a number distribution regarding the diameters of fine bubbles. If the average air bubble diameter is less than 0.01 μm, the size of the fine bubble supply mechanism 50 is increased, and it may be difficult to supply fine bubbles with adjusted air bubble diameters. Further, if the average air bubble diameter is more than 100 μm, the rising speed of the fine bubble is increased and accordingly the lifetime of the fine bubble in the cleaning liquid is shortened, and there is a case where practical cleaning cannot be performed. Further, if the air bubble diameter is too large, ultrasonic propagation is inhibited by fine bubbles, and the effect of improving the detergency of ultrasonic waves may be reduced.

The concentration (density) of fine bubbles in the cleaning liquid 3 is preferably $10^3$/mL to $10^{10}$/mL. If the concentration of fine bubbles is less than $10^3$/mL, the action of improving ultrasonic propagation ability based on fine bubbles may not be obtained sufficiently, and the number of nuclei of ultrasonic cavitation necessary for cleaning is small; thus, this is not preferable. Further, if the concentration of fine bubbles is more than $10^{10}$/mL, the size of the bubble generation apparatus is increased or the number of bubble generation apparatuses is increased, and the supply of fine bubbles may not be practicable; thus, this is not preferable.

Further, the fine bubble supply mechanism 50 preferably supplies fine bubbles in such a manner that, in the cleaning liquid 3, the proportion of the number of fine bubbles each having an air bubble diameter less than or equal to a frequency resonance diameter, which is a diameter resonating with the frequency of the ultrasonic wave, is more than or equal to 70% of the number of all the fine bubbles existing in the cleaning liquid 3. The reason will now be described.

The natural frequency of various air bubbles including fine bubbles is also called the Minnaert resonance frequency, and is given by Formula 101 below.

[Math. 1]

$$f_0 = \frac{1}{2\pi R_0}\sqrt{\frac{3\gamma p_\infty}{\rho}} \quad \text{(Formula 101)}$$

Here, in Formula 101 above, $f_0$: The natural frequency of the air bubble (Minnaert resonance frequency)

$R_0$: The average radius of the air bubble $p_\infty$: The average pressure of the ambient liquid $\gamma$: The heat capacity ratio ($\gamma$ of air=1.4)

$\rho$: The density of the liquid.

Here, when it is assumed that, supposing that air exists in the interior of a focused-on air bubble, the ambient liquid of the air bubble is water and the pressure is atmospheric pressure, the value of the product $f_0R_0$ of the natural frequency of the air bubble and the average radius of the air bubble is approximately 3 kHz·mm from Formula 101 above. From this, when the frequency of the applied ultrasonic wave is 20 kHz, the radius $R_0$ of an air bubble resonating with such an ultrasonic wave is approximately 150 μm, and accordingly a frequency resonance diameter $2R_0$, which is the diameter of an air bubble resonating with an ultrasonic wave with a frequency of 20 kHz, is approximately 300 μm. Similarly, when the frequency of the applied ultrasonic wave is 100 kHz, the radius $R_0$ of an air bubble resonating with such an ultrasonic wave is approximately 30 μm, and accordingly a frequency resonance diameter $2R_0$, which is the diameter of an air bubble resonating with an ultrasonic wave with a frequency of 100 kHz, is approximately 60 μm.

At this time, an air bubble having a radius larger than the resonance radius $R_0$ is an inhibition factor. This is because, when air bubbles including fine bubbles resonate, the air bubbles repeat expansion and contraction within a short time, and crush in the end; however, when the size of the air bubble is larger than the frequency resonance diameter $2R_0$ at the time point when first sound waves pass through the air bubble, the ultrasonic waves diffuse at the surface of the air bubble. Conversely, when the size of the air bubble is smaller than the frequency resonance diameter $2R_0$ at the time point when first sound waves pass through the air bubble, the ultrasonic waves can pass through the air bubble without diffusing at the surface of the air bubble.

From such a point of view, it is preferable that, in the cleaning liquid 3, the proportion of the number of fine bubbles each having an air bubble diameter less than or equal to the frequency resonance diameter $2R_0$ be more than or equal to 70% of the number of all the fine bubbles existing in the cleaning liquid 3. The efficiency of ultrasonic propagation can be further improved by setting the proportion of the number of fine bubbles each having an air bubble diameter less than or equal to the frequency resonance diameter $2R_0$ to more than or equal to 70%. Further, by propagating first sound waves up to the wall surface and/or the bottom surface of the treatment tank 10, the diffusion and reflection of ultrasonic waves to the entire treatment tank 10 are repeated, and a uniform ultrasonic treatment tank can be obtained. Further, also air bubbles each having an air bubble diameter less than or equal to the frequency resonance diameter $2R_0$ repeat expansion and contraction and crush after a lapse of a prescribed ultrasonic irradiation time, and can contribute to cavitation cleaning.

The proportion of the number of fine bubbles each having an air bubble diameter less than or equal to the frequency resonance diameter $2R_0$ is preferably less than or equal to 98% in view of the fact that there are not a few bubbles that expand immediately after fine bubble generation. The proportion of the number of fine bubbles each having an air bubble diameter less than or equal to the frequency resonance diameter $2R_0$ is more preferably more than or equal to 80% and less than or equal to 98%.

Here, for the basic mechanism of fine bubble generation, there are various mechanisms such as the shearing of air bubbles, the passage of air bubbles through micropores, cavitation (vaporization) by decompression, the compression dissolution of gas, ultrasonic waves, electrolysis, and chemical reaction, and a mechanism may be selected as appropriate. In the fine bubble supply mechanism 50 according to the present embodiment, it is preferable to use a fine bubble generation system that is capable of easily controlling the air bubble diameter and the concentration of fine bubbles. This fine bubble generation system is, for example, a system that generates fine bubbles using a shearing system, then allows the cleaning liquid to pass through a filter having micropores with prescribed sizes, and thereby controls the air bubble diameter etc. of fine bubbles.

Here, the average air bubble diameter and the concentration (density) of fine bubbles can be measured by known devices such as an in-liquid particle counter and an air bubble diameter distribution measuring apparatus. Examples include SALD-7100H manufactured by Shimadzu Corporation, which can measure an air bubble diameter distribution in a wide range (several nanometers to several hundred micrometers) by calculation from a scattered light distribution in a laser diffraction scattering method, Multisizer 4 manufactured by Beckman Coulter, Inc., which can measure the number and the concentration of bubbles of micrometer-order size from an electrical resistance change at the time of aperture passage in an electrical resistance method, NanoSight LM10 manufactured by Malvern Panalytical Ltd., which can measure the number and the concentration of bubbles of nanometer-order size from the speed of Brownian motion by using an observation video of the Brownian motion of particles under laser light irradiation in a Brownian motion observation method, and the like.

For the surface potential of a fine bubble generated in the above manner, the surface is generally charged negative in the liquidity condition of an ordinary cleaning liquid 3. On the other hand, a cleaning object existing on the surface of the object to be cleaned (for example, scale, smut, oil, etc. on a steel pipe) is generally charged positive; hence, when a fine bubble arrives at the vicinity of the cleaning object, the fine bubble is attracted to the cleaning object due to such a difference in electrostatic properties. In the case where the ultrasonic cleaning equipment 1 according to the present embodiment includes the fine bubble supply mechanism 50, fine bubbles can further clean the cleaning object off by generating cavitation by means of applied ultrasonic waves, and cleaning can be performed with better efficiency.

<Reflector>

It is preferable that a reflector for reflecting ultrasonic waves be provided on the wall surface and the bottom surface on the cleaning liquid side of the treatment tank 10. By providing such a reflector, ultrasonic waves that have arrived at the wall surface and the bottom surface of the treatment tank 10 are reflected by the reflector, and propagate toward the cleaning liquid 3 again. Thereby, ultrasonic waves applied into the cleaning liquid 3 can be utilized with good efficiency. In the present embodiment, even though a reflector is placed, the generation of standing waves is prevented by virtue of the fact that the curved surface member 30 is placed in the treatment tank 10.

Figure 6:
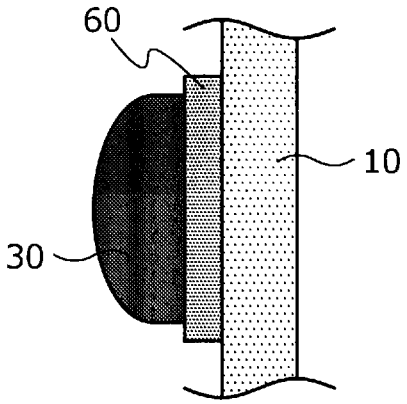
FIG. 6 is an explanatory diagram for describing a curved surface member according to the embodiment.

In particular, for example as schematically shown in FIG. 6, a reflector 60 that reflects ultrasonic waves may be provided between the curved surface member 30 and the wall surface or the bottom surface of the treatment tank 10 on which such a curved surface member 30 is held, and thereby ultrasonic waves can be utilized with better efficiency.

Further, reflectors may be placed in parts of the wall surface and the bottom surface of the treatment tank 10 where the curved surface member 30 is not placed. By reflectors thus existing, ultrasonic waves are prevented from being absorbed by the wall surface or the bottom surface of the treatment tank 10, and are reflected. Thereby, ultrasonic waves applied into the cleaning liquid 3 can be utilized with good efficiency. In this case, the area ratio of the reflectors to the parts of the wall surface and the bottom surface in contact with the cleaning liquid of the treatment tank 10 where the curved surface member 30 is not placed is preferably as large as possible, and is not particularly limited; for example, may be more than or equal to 80%, and preferably more than or equal to 90%.

Hereinabove, an overall configuration of the ultrasonic cleaning equipment 1 according to the present embodiment is described in detail with reference to FIG. 1A to FIG. 6.

(Frequency Sweep Processing)

Next, frequency sweep processing in the ultrasonic application mechanism 20 is briefly described.

As mentioned above, it is preferable for the ultrasonic application mechanism 20 according to the present embodiment to have a frequency sweep function that can apply an ultrasonic wave while sweeping frequency in a range of ±0.1 kHz to ±10 kHz about a selected ultrasonic frequency. By such a frequency sweep function, two additional effects described below can be obtained.

When an ultrasonic wave is applied to minute air bubbles including fine bubbles existing in a liquid, a force called Bjerknes force acts on minute air bubbles, and minute air bubbles are attracted to the positions of antinodes and nodes of the ultrasonic wave in accordance with a resonance air bubble radius $R_0$ depending on frequency. Here, when the frequency of the ultrasonic wave is changed by the frequency sweep function possessed by the ultrasonic application mechanism 20, the range of the resonance air bubble radius $R_0$ depending on frequency is widened in accordance with the change in frequency. Consequently, the range of the bubble diameter of cavitation generation is widened, and a large number of minute air bubbles (for example, fine bubbles) can be utilized as cavitation nuclei. Thus, the cleaning efficiency of the ultrasonic cleaning equipment 1 according to the present embodiment is further improved by the frequency sweep function possessed by the ultrasonic application mechanism 20.

On the other hand, as a common property of an ultrasonic wave, there is known a phenomenon in which "an ultrasonic wave is transmitted through an irradiated body when the wavelength of the ultrasonic wave is ¼ of a wavelength corresponding to the thickness of the irradiated body." Thus, by applying ultrasonic waves while sweeping frequency in an appropriate range, in the case where, for example, the object to be cleaned is a body having a hollow portion such as a tubular body, the amount of ultrasonic waves transmitted into the inside of the tubular body can be increased, and the cleaning efficiency of the ultrasonic cleaning equipment 1 according to the present embodiment is further improved.

Here, when the transmission of ultrasonic waves at the surface of an irradiated body is considered, there are not only ultrasonic waves incident perpendicular to the irradiated body but also ultrasonic waves propagating while repeating multiple reflection, and therefore there is a tendency that a certain sound field is less likely to be formed. In such circumstances, in order to create a condition for transmission through the wall surface of the irradiated body, it is preferable that a frequency capable of satisfying the condition that "the wavelength of the ultrasonic wave be ¼ of a wavelength corresponding to the thickness of the object to be cleaned" be obtained wherever the position of the object to be cleaned exists. For such a range of frequency, a study by the present inventors has revealed that the transmission of ultrasonic waves like that mentioned above can be achieved by applying ultrasonic waves while sweeping frequency in a range of ±0.1 kHz to ±10 kHz about a selected ultrasonic frequency.

EXAMPLES

Next, the ultrasonic cleaning equipment and the ultrasonic cleaning method according to the present invention are specifically described with reference to Examples and Comparative Examples. Examples shown below are only examples of the ultrasonic cleaning equipment and the ultrasonic cleaning method according to the present invention, and the ultrasonic cleaning equipment and the ultrasonic cleaning method according to the present invention are not limited to examples shown below.

Experimental Example 1

Figure 7A:
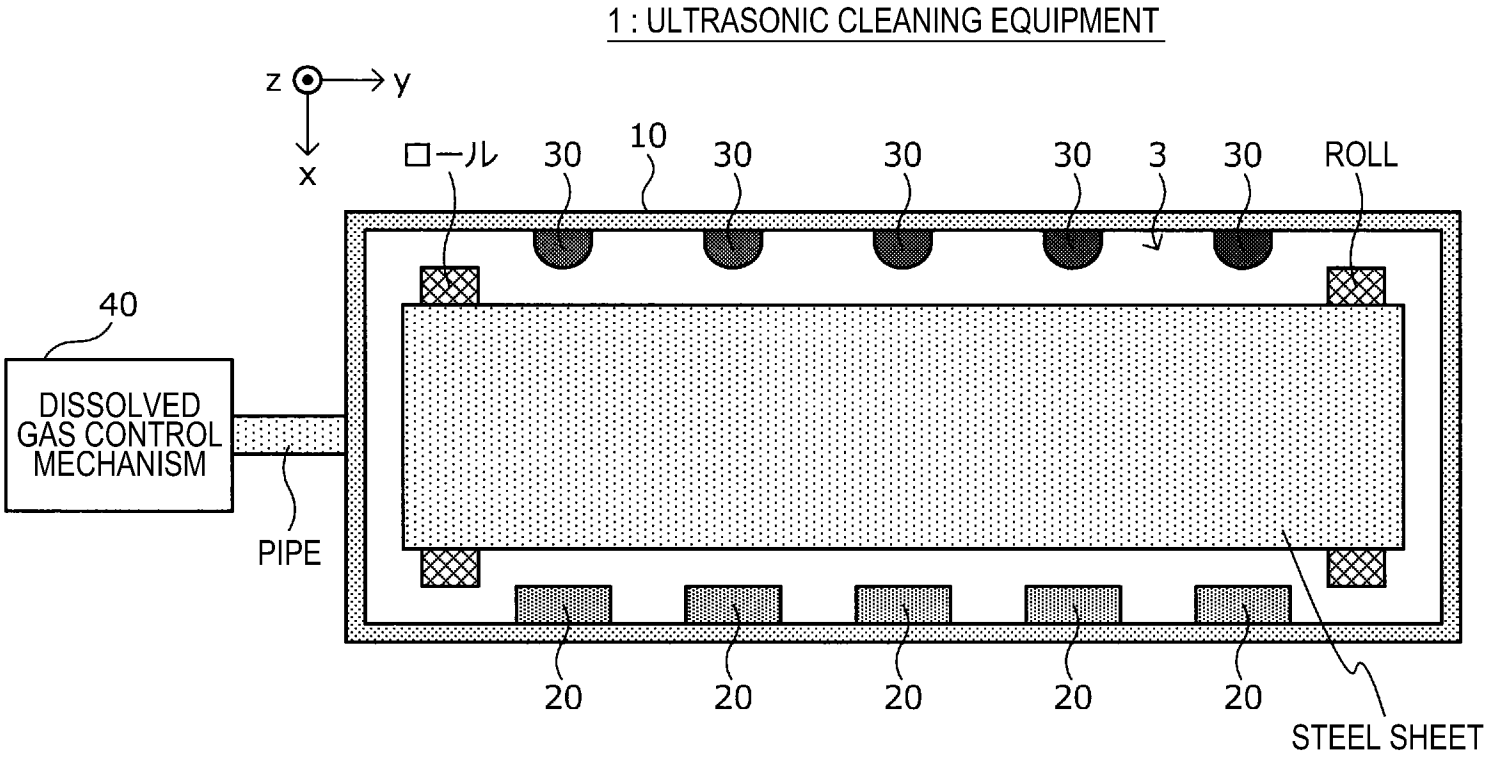
FIG. 7A is an explanatory diagram schematically showing a configuration of an ultrasonic cleaning equipment used in Experimental Example 1.
Figure 7B:
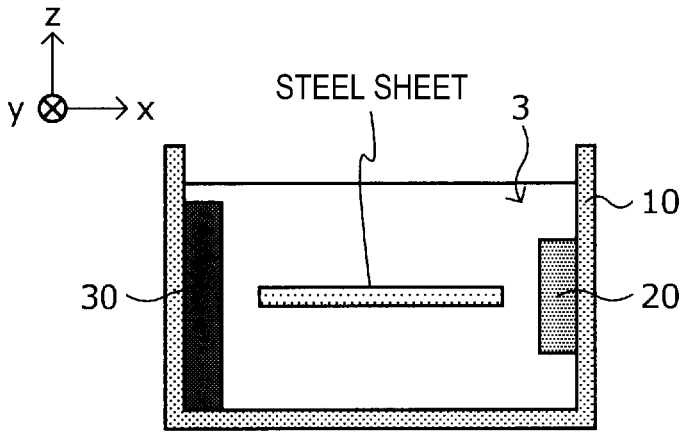
FIG. 7B is an explanatory diagram schematically showing a configuration of an ultrasonic cleaning equipment used in Experimental Example 1.

In the present Experimental Example, water washing (rinse) treatment of a steel sheet was performed using an ultrasonic cleaning equipment 1 like that schematically shown in FIG. 7A and FIG. 7B. Clean water at normal temperature (25° C.) was used as a rinse solution. A treatment tank having an outer wall made of SUS and having a volume of 7 $m^3$ of 2.0 m wide×7 m long×0.5 m deep was used as the treatment tank 10. A steel sheet, which was an object to be cleaned, was set in a state of being held by rolls provided in the treatment tank 10. As an ultrasonic oscillator of the ultrasonic application mechanism 20, one with a power of 1200 W was used. As schematically shown in FIG. 7A and FIG. 7B, five immersion vibrators made of SUS were arranged on the wall surface of one long side of the treatment tank 10, with the frequency of the ultrasonic wave set to 40 kHz (the wavelength λ at the speed of sound c=1500 m/s: 37.5 mm); and ultrasonic waves were applied. As schematically shown in FIG. 7A and FIG. 7B, five curved surface members 30 were installed on the wall surface on a side of the treatment tank 10 where an ultrasonic vibrator was not provided, so as to face the immersion vibrators made of SUS. For the curved surface member 30 installed in the treatment tank 10, the size, the shape, the material quality (specific acoustic impedance), the surface area, the distance from the vibrating surface, and the distance between curved surface members 30 were each changed; and the obtained results were compared. In the present Experimental Example, a membrane-type deaeration apparatus, PDO4000P manufactured by Miura Co., Ltd., was used as the dissolved gas control mechanism 40, and the amount of dissolved gas was controlled at the time of the test. Using a dissolved oxygen meter, LAQUA OM-51 manufactured by Horiba, Ltd., the amount of dissolved oxygen was measured as a value in proportion to the amount of dissolved gas; and the amount of dissolved gas (%) relative to the saturation amount of dissolved gas was estimated. The amounts of dissolved gas of 5%, 40%, and 95% in Table 1 and Table 2 below correspond to, as specific concentrations, 1.1 ppm, 9.1 ppm, and 21.5 ppm, respectively. Further, the amount of dissolved gas of 95% is a value in the case where clean water not subjected to dissolved gas control was used as it was.

Figure 8:
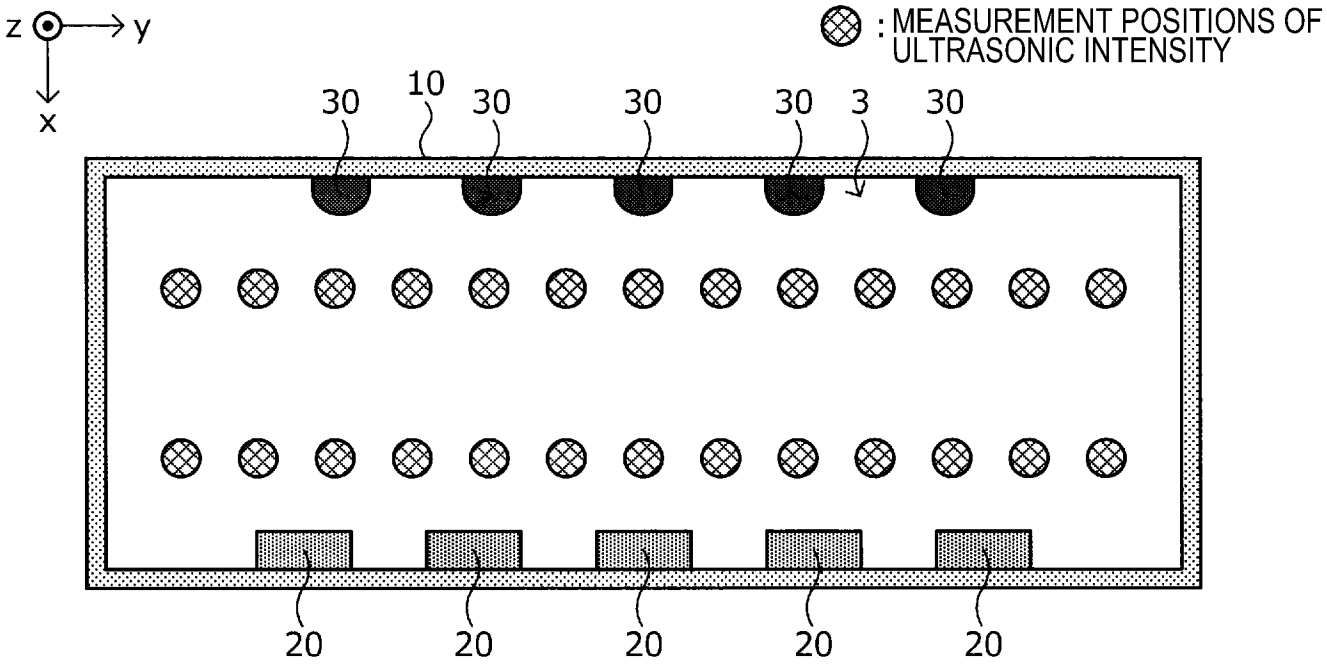
FIG. 8 is an explanatory diagram for describing measurement positions of ultrasonic intensity in Experimental Example 1.

In the present Experimental Example, as schematically shown in FIG. 8, an ultrasonic level monitor (19001D manufactured by Kaijo Corporation) was used to measure the ultrasonic intensity (mV) at intervals of 0.5 m in the length direction of the treatment tank 10, at a total of 26 positions 0.5 m from the wall surfaces in the width direction of the treatment tank 10, and the relative ultrasonic intensity (the relative intensity on the assumption that the measurement result of Comparative Example 1, that is, the ultrasonic intensity measured in the case where the convex curved part 33 was not installed is 1) and the standard deviation (σ) were calculated; thus, the ultrasonic propagation abilities of the entire treatment tanks 10 were compared. In Comparative Example 5 shown below, the curved surface member 30 was provided on the same wall surface as the wall surface on which the immersion vibrator made of SUS was provided, and the convex curved part 33 was set so as not to face the vibrating surface. The experimental conditions and the obtained results of the present Experimental Example are collectively shown in Table 1 and Table 2 below.

In Table 1 and Table 2 below, the shape written as "round pipe" among the shapes of the curved surface member means that a hollow tubular body in which the external shape of a cross section perpendicular to the long axis direction is a circular shape was used, and the shape written as "circular column" means that a solid columnar body in which the external shape of a cross section perpendicular to the long axis direction is a circular shape was used. Further, the shape written as "flat pipe" among the shapes of the curved surface member means that a hollow tubular body in which the external shape of a cross section perpendicular to the long axis direction is an elliptical shape was used. Further, the shape written as "corrugated plate (rectangular)" means that a corrugated plate in which a corrugated portion functions as the non-convex curved portion 35 was used. Further, the shape written as "embossed" among the shapes of the curved surface member means that a member in which a surface of a plate-like material is embossed in hemispheres each having a diameter of 10 mm and arranged in a zigzag arrangement was used. Further, the shape written as "round pipe+shield plate" among the shapes of the curved surface member means that a shield plate that blocks first sound waves was placed between the immersion vibrator made of SUS of the ultrasonic application mechanism 20 and a round pipe.

In Table 1 and Table 2 below, "maximum height H" means the maximum height of a convex curved part 33 like that described above that is convex toward the surface of the vibrator; in the case of a round pipe or a circular column, the maximum height H is a value corresponding to the radius. Further, in Table 1 and Table 2 below, "area ratio of convex curved part in member" means the area ratio of the convex curved part 33 facing the surface of the vibrator in the curved surface member 30. Further, in Table 1 and Table 2 below, "number of curved surface members" means the number of convex curved parts 33 in one curved surface member 30, and is written as 1 in the case where the convex curved part 33 is in a continuous shape.

TABLE 1

| | Curved surface member | | | | | Placement of curved surface member |
|---|---|---|---|---|---|---|
| | Shape | Maximum height H [mm] | Area ratio of convex curved portion in member [%] | Specific acoustic impedance | Number | Maximum value of separation distance D to vibrating surface [m] |
| Example 1 | Round pipe | 15.0 | 100 | $3.97 \times 10^7$ | 1 | 2.1 |
| Example 2 | Round pipe | 32.5 | 100 | $3.97 \times 10^7$ | 1 | 2.6 |
| Example 3 | Round pipe | 32.5 | 100 | $3.97 \times 10^7$ | 1 | 2.4 |
| Example 4 | Round pipe | 32.5 | 100 | $3.97 \times 10^7$ | 1 | 2.2 |
| Example 5 | Round pipe | 32.5 | 100 | $3.97 \times 10^7$ | 1 | 2.1 |
| Example 6 | Round pipe | 32.5 | 100 | $3.97 \times 10^7$ | 5 | 2.2 |
| Example 7 | Round pipe | 32.5 | 100 | $3.97 \times 10^7$ | 20 | 2.2 |
| Example 8 | Round pipe | 45.0 | 100 | $3.97 \times 10^7$ | 20 | 2.2 |
| Example 9 | Round pipe | 32.5 | 100 | $3.97 \times 10^7$ | 40 | 2.1 |
| Example 10 | Round pipe | 32.5 | 100 | $2.77 \times 10^6$ | 1 | 2.1 |
| Example 11 | Round pipe | 32.5 | 100 | $2.15 \times 10^6$ | 1 | 2.1 |
| Example 12 | Flat pipe | 25.0 | 28 | $1.38 \times 10^7$ | 5 | 2.2 |

TABLE 1-continued

| | Placement of curved surface member | | | Amount of dissolved gas | | |
|---|---|---|---|---|---|---|
| | Angle of inclination θ [°] | Area ratio in vibrator effective range [%] | Spacing between members [mm] | Proportion to saturation amount [%] | Ultrasonic intensity Relative intensity (average) | Ultrasonic intensity Standard deviation σ |
| Example 1 | 14.0 | 0.9 | — | 95 | 1.52 | 16.3 |
| Example 2 | 40.4 | 0.8 | — | 95 | 1.50 | 15.5 |
| Example 3 | 33.0 | 1.0 | — | 95 | 1.55 | 15.0 |
| Example 4 | 26.6 | 1.3 | — | 95 | 2.12 | 10.8 |
| Example 5 | 14.0 | 2.0 | — | 95 | 2.16 | 11.0 |
| Example 6 | 26.6 | 6.3 | 500 | 95 | 2.23 | 10.2 |
| Example 7 | 26.6 | 25.3 | 500 | 95 | 2.35 | 11.0 |
| Example 8 | 26.6 | 35.0 | 450 | 95 | 2.05 | 10.6 |
| Example 9 | 14.0 | 80.4 | 25 | 95 | 1.60 | 14.5 |
| Example 10 | 14.0 | 2.0 | — | 95 | 1.51 | 16.5 |
| Example 11 | 14.0 | 2.0 | — | 95 | 1.50 | 16.8 |
| Example 12 | 26.6 | 1.8 | 250 | 95 | 1.65 | 16.3 |

TABLE 2

| | Curved surface member | | | | | Placement of curved surface member |
|---|---|---|---|---|---|---|
| | Shape | Maximum height H [mm] | Area ratio of convex curved portion in member [%] | Specific acoustic impedance | Number | Maximum value of separation distance D to vibrating surface [m] |
| Example 13 | Flat pipe | 30.0 | 42 | $1.38 \times 10^7$ | 5 | 2.2 |
| Example 14 | Circular column | 32.5 | 100 | $1.38 \times 10^7$ | 5 | 2.5 |
| Example 15 | Embossed | 5.0 | 100 | $1.38 \times 10^7$ | 1800 | 2.1 |
| Example 16 | Embossed | 20.0 | 30 | $1.38 \times 10^7$ | 500 | 2.1 |
| Example 17 | Round pipe | 32.5 | 100 | $3.97 \times 10^7$ | 5 | 2.2 |
| Example 18 | Round pipe | 32.5 | 100 | $3.97 \times 10^7$ | 5 | 2.2 |
| Example 19 | Round pipe | 32.5 | 100 | $1.03 \times 10^8$ | 1 | 2.1 |
| Example 20 | Round pipe | 32.5 | 100 | $3.97 \times 10^7$ | 1 | 0.04 |
| Comparative Example 1 | — | — | — | — | — | — |
| Comparative Example 2 | Rectangular pipe | 50.0 | 0 | $1.38 \times 10^7$ | 10 | 2.1 |
| Comparative Example 3 | Corrugated plate (rectangular) | 19.0 | 0 | $3.97 \times 10^7$ | 14 | 2.1 |
| Comparative Example 4 | Round pipe + shield plate | 32.5 | 100 | $3.97 \times 10^7$ | 1 | 2.1 |
| Comparative Example 5 | Round pipe | 32.5 | 100 | $3.97 \times 10^7$ | 6 | 0.5 |

| | Placement of curved surface member | | | Amount of dissolved gas | | |
|---|---|---|---|---|---|---|
| | Angle of inclination θ [°] | Area ratio in vibrator effective range [%] | Spacing between members [mm] | Proportion to saturation amount [%] | Ultrasonic intensity Relative intensity (average) | Ultrasonic intensity Standard deviation σ |
| Example 13 | 26.6 | 2.6 | 250 | 95 | 2.20 | 13.0 |
| Example 14 | 36.9 | 4.6 | 750 | 95 | 1.75 | 15.0 |
| Example 15 | 14.0 | 22.3 | 5 | 95 | 1.60 | 16.5 |
| Example 16 | 14.0 | 6.2 | 100 | 95 | 2.30 | 11.0 |
| Example 17 | 26.6 | 6.3 | 500 | 40 | 3.56 | 5.9 |
| Example 18 | 26.6 | 6.3 | 500 | 5 | 3.60 | 5.0 |
| Example 19 | 14.0 | 2.0 | — | 95 | 2.41 | 10.1 |
| Example 20 | 14.0 | 2.0 | — | 95 | 1.52 | 16.8 |
| Comparative Example 1 | — | — | — | 95 | 1.00 | 22.6 |
| Comparative Example 2 | 14.0 | 0.0 | 450 | 95 | 1.01 | 21.9 |
| Comparative Example 3 | 14.0 | 0.0 | 250 | 95 | 0.98 | 23.2 |

TABLE 2-continued

| | | | | | | |
|---|---|---|---|---|---|---|
| Comparative Example 4 | 14.0 | 2.0 | — | 95 | 1.05 | 22.5 |
| Comparative Example 5 | 90.0 | 1.1 | 100 | 95 | 1.03 | 22.2 |

First, referring to Comparative Examples, in Comparative Examples 2 to 3 in which a curved surface member 30 in which the convex curved part 33 did not exist was provided, Comparative Example 4 in which a shield plate that was provided in front of the convex curved part 33 so as to block ultrasonic waves of first sound waves existed, and Comparative Example 5 in which the convex curved part was provided on the same wall surface as the wall surface of the vibrating surface, the average of the relative ultrasonic intensity of the entire treatment tank 10 was almost equal to that of Comparative Example 1 in which the curved surface member 30 according to an embodiment of the present invention was not held in the treatment tank. Further, the standard deviation, which is a variation index, is more than an ultrasonic intensity of 33 mV by 20, and it can be seen that ultrasonic propagation is non-uniform.

On the other hand, in Examples 1 to 20 in which the curved surface member 30 according to an embodiment of the present invention was provided, it was shown that the relative ultrasonic intensity was a high value of more than or equal to 1.5 times. In particular, in Examples 4 to 8 in which the separation distance D from the surface of the vibrator was within 2.5 m and the convex curved part 33 was provided at an area ratio of more than or equal to 1% and less than or equal to 80% in the vibrator effective range of less than or equal to 30° on the outside, a relative ultrasonic intensity of more than or equal to twice was observed, and the standard deviation was small. Also in Examples 13, 16, and 18 in which, when the shape of the convex curved part 33 was changed, the area ratio was in the range of more than or equal to 1% and less than or equal to 80% and the maximum height H of the convex curved part 33 was $\lambda/2<H$, similarly a relative ultrasonic intensity of more than or equal to twice was observed.

Further, the relative ultrasonic intensity was higher in Example 5, which was made of a material with a specific acoustic impedance of more than or equal to $1\times10^7$, than in Examples 10 and 11, which were made of a material with a specific acoustic impedance of less than $1\times10^7$. Further, in Examples 17 and 18 in which the amount of dissolved gas was controlled, the relative ultrasonic intensity was more than or equal to 3.5 times that of Comparative Example 1, and the standard deviation was still smaller; thus, more uniform propagation was observed.

Experimental Example 2

Figure 9A:
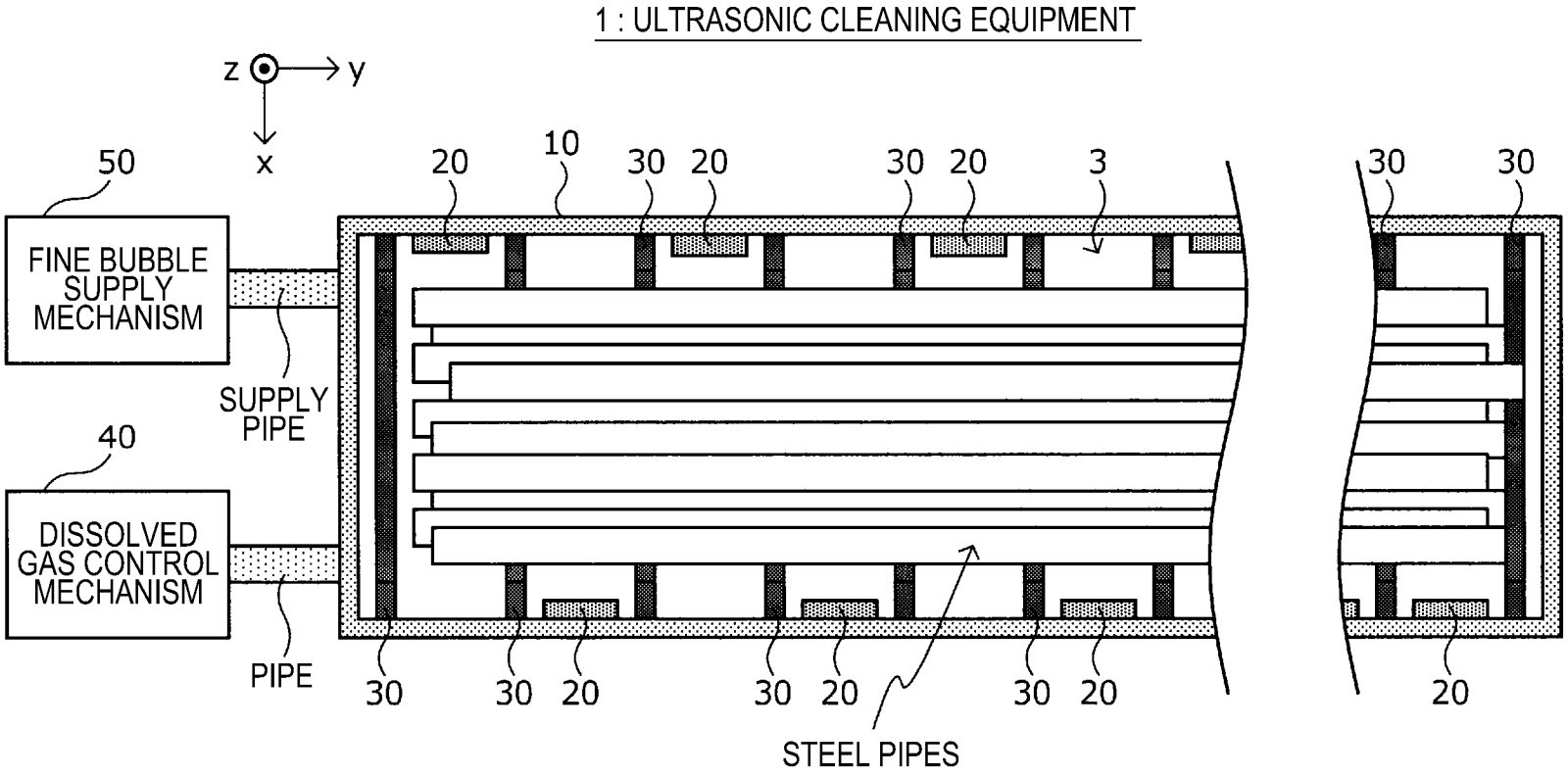
FIG. 9A is an explanatory diagram schematically showing a configuration of an ultrasonic cleaning equipment used in Experimental Example 2.
Figure 9B:
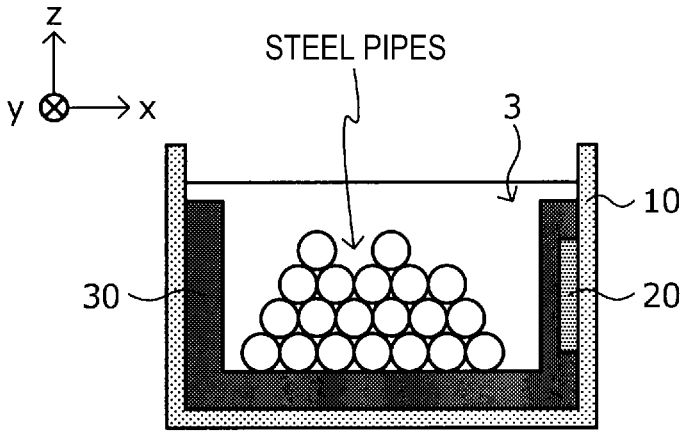
FIG. 9B is an explanatory diagram schematically showing a configuration of an ultrasonic cleaning equipment used in Experimental Example 2.

In the present Experimental Example, degreasing treatment of steel pipes in which oil was attached to surfaces was performed using an ultrasonic cleaning equipment 1 like that schematically shown in FIG. 9A and FIG. 9B. An alkali-based degreasing liquid at a temperature of 60° C. was used as a degreasing solution. A treatment tank having an outer wall made of steel and a surface lined with polytetrafluoroethylene (PTFE) and having a volume of 9 $m^3$ of 1.0 m wide×15.0 m long×0.6 m deep was used as the treatment tank 10. Steel pipes in which oil was attached to surfaces were immersed in such a treatment tank 10 for a prescribed time. Specifically, 20 steel pipes each with an inner diameter of 40 mm and a length of 10 m were placed in the center in the treatment tank 10, as objects to be cleaned, and the evaluation of cleaning was performed.

As an ultrasonic oscillator of the ultrasonic application mechanism 20, one with a power of 1200 W was used. Ten immersion vibrators made of SUS were used as ultrasonic vibrators; as schematically shown in FIG. 9A and FIG. 9B, five immersion vibrators were installed on each of the wall surfaces in the longitudinal direction of the treatment tank 10. The ultrasonic oscillator used was one capable of sweeping ultrasonic frequency; in the present Experimental Example, the frequency was set to 25 kHz to 192 kHz. The wavelength 2 corresponding to each ultrasonic frequency f can be calculated from the relation of $c=f\cdot\lambda$, where the speed of sound c=1550 m/s.

As schematically shown in FIG. 9A and FIG. 9B, curved surface members 30 were installed in parts of the wall surface and the bottom surface of the treatment tank 10, and the steel pipes, which were objects to be cleaned, were held on the curved surface members 30. In some Examples, a reflector of a prescribed material quality was installed between the wall surface of the treatment tank 10 and the curved surface member 30. Such a curved surface member 30 was a pipe made of SUS, and the interior was made hollow. The shape (external shape), the size, the number, and the distance from the vibrating surface of the curved surface member 30 were changed variously, and the obtained results were compared.

In the present Experimental Example, a membrane-type deaeration apparatus, PDO4000P manufactured by Miura Co., Ltd. was used as the dissolved gas control mechanism 40, and the amount of dissolved gas relative to the saturation amount of dissolved gas was controlled to 0.5%, 40%, or 95% during the experiment. At the time of such control, using a dissolved oxygen meter, LAQUA OM-51 manufactured by Horiba, Ltd., the amount of dissolved oxygen was measured as a value in proportion to the amount of dissolved gas; and the amount of dissolved gas (%) relative to the saturation amount of dissolved gas was estimated. The amounts of dissolved gas of 0.5%, 40%, and 95% in Tables 3 and 4 below correspond to, as specific concentrations, 0.08 ppm, 6.4 ppm, and 15.2 ppm, respectively. Further, the amount of dissolved gas of 95% is a value in the case where clean water not subjected to dissolved gas control was used as it was.

In the present Experimental Example, 2FKV-27M/MX-F13 manufactured by OHR Laboratory Corporation was used as the fine bubble supply mechanism 50; ultrasonic waves and fine bubbles were used in combination while fine bubbles were supplied to the degreasing solution; and verification was performed. The air bubble diameter (average air bubble diameter) and the total number of fine bubbles were measured using a precision particle size distribution measuring apparatus (Multisizer 4 manufactured by Beckman Coulter, Inc.) and a nanoparticle analyzing apparatus (NanoSight LM10 manufactured by Malvern Panalytical Ltd.).

In the present Experimental Example, the rate of oil removal of the surface of the steel sheet was measured, and the measured rate of oil removal was evaluated as degreasing capacity. In more detail, the amount of oil removed was calculated from the amount of change in mass between before and after cleaning, and the proportion of the amount of oil removed that was able to be removed by the respective cleaning conditions to the total amount of oil attached to the surface of the steel sheet was taken as the rate of oil removal. The evaluation criteria of degreasing capacity in Tables 3 and 4 below are as follows.

Rate of Oil Removal

Less than or equal to 100% and more than or equal to 98%: A1

Less than 98% and more than or equal to 95%: A2

Less than 95% and more than or equal to 93%: B1

Less than 93% and more than or equal to 90%: B2

Less than 90% and more than or equal to 85%: C1

Less than 85% and more than or equal to 80%: C2

Less than 80% and more than or equal to 60%: D

Less than 60% and more than or equal to 40%: E

Less than 40%: F

That is, evaluation A1 to evaluation B2 mean that the degreasing capacity was very good, evaluations C1 and C2 mean that the degreasing capacity was good, evaluation D means that the degreasing capacity was a little poor, and evaluation E and evaluation F mean that the degreasing capacity was poor.

TABLE 3

| | Curved surface member | | | Placement of curved surface member | | | | |
|---|---|---|---|---|---|---|---|---|
| | Shape | Maximum height H [mm] | Number | Maximum value of separation distance D to vibrating surface [m] | Angle of inclination θ [°] | Area ratio in vibrator effective range [%] | Spacing between members [mm] | Ultrasonic wave Frequency [kHz] |
| Example 1 | Round | 15.0 | 1 | 1.1 | 26.6 | 4.4 | — | 35 |
| Example 2 | Round | 32.5 | 1 | 1.1 | 26.6 | 9.4 | — | 35 |
| Example 3 | Round | 32.5 | 1 | 1.2 | 35.0 | 7.6 | — | 35 |
| Example 4 | Round | 45.0 | 1 | 1.2 | 35.0 | 10.5 | — | 35 |
| Example 5 | Round | 32.5 | 5 | 1.1 | 26.6 | 47.2 | 250 | 35 |
| Example 6 | Round | 32.5 | 1 | 1.1 | 26.6 | 9.4 | — | 25 |
| Example 7 | Round | 32.5 | 1 | 1.1 | 26.6 | 9.4 | — | 100 |
| Example 8 | Round | 32.5 | 1 | 1.1 | 26.6 | 9.4 | — | 192 |
| Example 9 | Round | 32.5 | 1 | 1.1 | 26.6 | 9.4 | — | 35 |
| Example 10 | Round | 32.5 | 1 | 1.1 | 26.6 | 9.4 | — | 35 |
| Example 11 | Round | 32.5 | 1 | 1.1 | 26.6 | 9.4 | — | 100 |
| Example 12 | Round | 32.5 | 1 | 1.1 | 26.6 | 9.4 | — | 100 |
| Example 13 | Round | 32.5 | 1 | 1.1 | 26.6 | 9.4 | — | 100 |
| Example 14 | Round | 32.5 | 1 | 1.1 | 26.6 | 9.4 | — | 100 |
| Example 15 | Round | 32.5 | 1 | 1.1 | 26.6 | 9.4 | — | 100 |
| Example 16 | Round | 32.5 | 1 | 1.1 | 26.6 | 9.4 | — | 100 |
| Example 17 | Round | 15.0 | 1 | 1.1 | 26.6 | 4.4 | — | 35 |
| Example 18 | Round | 15.0 | 1 | 1.1 | 26.6 | 4.4 | — | 35 |

| | Ultrasonic wave Sweeping [kHz] | Fine bubble Average diameter [μm] | Total number [/ml] | Proportion of number of bubbles with diameter less than or equal to resonance diameter [%] | Amount of dissolved gas Proportion to saturation amount [%] | Reflector | Cleaning capacity |
|---|---|---|---|---|---|---|---|
| Example 1 | — | — | — | — | 40 | — | C2 |
| Example 2 | — | — | — | — | 40 | — | B2 |
| Example 3 | — | — | — | — | 40 | — | C1 |
| Example 4 | — | — | — | — | 40 | — | C1 |
| Example 5 | — | — | — | — | 40 | — | B1 |
| Example 6 | — | — | — | — | 40 | — | C1 |
| Example 7 | — | — | — | — | 40 | — | B2 |
| Example 8 | — | — | — | — | 40 | — | C1 |
| Example 9 | 0.1 | — | — | — | 40 | — | A2 |
| Example 10 | 2.0 | — | — | — | 40 | — | A2 |
| Example 11 | 0.1 | — | — | — | 40 | — | A2 |
| Example 12 | 10.0 | — | — | — | 40 | — | B2 |
| Example 13 | — | 0.09 | $1.0 \times 10^9$ | 98 | 40 | — | A2 |
| Example 14 | — | 0.09 | $5.0 \times 10^3$ | 98 | 40 | — | B1 |
| Example 15 | — | 1.0 | $2.0 \times 10^6$ | 98 | 40 | — | A1 |
| Example 16 | — | 10.0 | $4.6 \times 10^5$ | 70 | 40 | — | A2 |
| Example 17 | — | 80.0 | $3.0 \times 10^4$ | 40 | 40 | — | C1 |
| Example 18 | — | 110 | $2.3 \times 10^3$ | 33 | 40 | — | C2 |

TABLE 4

| | Curved surface member | | | Placement of curved surface member | | | | |
|---|---|---|---|---|---|---|---|---|
| | Shape | Maximum height H [mm] | Number | Maximum value of separation distance D to vibrating surface [m] | Angle of inclination θ [°] | Area ratio in vibrator effective range [%] | Spacing between members [mm] | Ultrasonic wave Frequency [kHz] |
| Example 19 | Round | 32.5 | 1 | 1.1 | 26.6 | 9.4 | — | 100 |
| Example 20 | Round | 32.5 | 1 | 1.1 | 26.6 | 9.4 | — | 100 |
| Example 21 | Round | 32.5 | 1 | 1.1 | 26.6 | 9.4 | — | 35 |
| Example 22 | Round | 32.5 | 1 | 1.1 | 26.6 | 9.4 | — | 35 |
| Example 23 | Round | 32.5 | 1 | 1.1 | 26.6 | 9.4 | — | 35 |
| Comparative Example 1 | — | — | — | — | — | — | — | 100 |
| Comparative Example 2 | — | — | — | — | — | — | — | 100 |
| Comparative Example 3 | Rectangular | 45 | 1 | 1.1 | 26.6 | 0.0 | — | 100 |
| Comparative Example 4 | Rectangular | 45 | 1 | 1.1 | 26.6 | 0.0 | — | 100 |
| Comparative Example 5 | Round + shield plate | 32.5 | 1 | 1.1 | 26.6 | 9.4 | — | 100 |
| Comparative Example 6 | — | — | — | — | — | — | — | 35 |

| | | Fine bubble | | | | | |
|---|---|---|---|---|---|---|---|
| | Ultrasonic wave Sweeping [kHz] | Average diameter [μm] | Total number [/ml] | Proportion of number of bubbles with diameter less than or equal to resonance diameter [%] | Amount of dissolved gas Proportion to saturation amount [%] | Reflector | Cleaning capacity |
| Example 19 | — | — | — | — | 40 | SUS304 | B1 |
| Example 20 | — | — | — | — | 40 | ceramic | B2 |
| Example 21 | — | — | — | — | 0.5 | — | C1 |
| Example 22 | — | — | — | — | 95 | — | C2 |
| Example 23 | 2.0 | 1.0 | $2.0 \times 10^6$ | 98 | 40 | — | A1 |
| Comparative Example 1 | — | — | — | — | 40 | — | F |
| Comparative Example 2 | — | 1.0 | $2.0 \times 10^6$ | 98 | 40 | — | E |
| Comparative Example 3 | — | — | — | — | 40 | — | F |
| Comparative Example 4 | — | 1.0 | $2.0 \times 10^6$ | 98 | 40 | — | E |
| Comparative Example 5 | — | — | — | — | 40 | — | D |
| Comparative Example 6 | — | — | — | — | 95 | Polycarbonate | E |

First, referring to Comparative Examples, a region where the degreasing capacity was poor or cleaning was insufficient occurred in Comparative Examples 1 and 2 in which the curved surface member 30 according to an embodiment of the present invention was not held in the treatment tank 10, Comparative Examples 3 and 4 in which a curved surface member 30 not having the convex curved part 33 was provided, Comparative Example 5 in which a shield plate that was provided in a front stage of the convex curved part 33 so as to block ultrasonic waves existed, and Comparative Example 6 in which a reflector was installed parallel in a position 775 mm from the surface of the vibrator (the distance between the reflector and the vibrating surface satisfied $\lambda/4\cdot(2n-1)$).

On the other hand, it has been found that the degreasing capacity is good in Examples 1 to 8 in which the convex curved part 33 according to an embodiment of the present invention was provided, and the maximum height H of the convex curved part 33, the area ratio of the convex curved part 33, the angle of inclination θ, and the range of frequency were changed. In particular, excellent degreasing capacity has been shown in Examples 9 to 17 and 23 in which the sweeping of frequency and the supply of fine bubbles in an appropriate range were performed. Further, excellent degreasing capacity has been shown also in Examples 19 and 20 in which a reflector was provided.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

REFERENCE SIGNS LIST

1 ultrasonic cleaning equipment
3 cleaning liquid
10 treatment tank

20 ultrasonic application mechanism
30 curved surface member
31 convex curved surface
33 convex curved part
35 non-convex curved portion
40 dissolved gas control mechanism
50 fine bubble supply mechanism
60 reflector

The invention claimed is:

1. An ultrasonic cleaning method that cleans an object to be cleaned by using a treatment tank in which a cleaning liquid that cleans the object to be cleaned is put, in which an ultrasonic application mechanism that applies ultrasonic waves to the cleaning liquid is provided to the treatment tank, and a curved surface member is provided to a wall surface and/or a bottom surface of the treatment tank located in a range defined by an angle of inclination from a perpendicular direction in an end portion of a vibrating surface of the ultrasonic application mechanism to an outside with respect to the vibrating surface, the ultrasonic cleaning method comprising:

applying ultrasonic waves to the cleaning liquid retained in the treatment tank; and immersing the object to be cleaned in the cleaning liquid to which ultrasonic waves are applied, wherein a plurality of the curved surface members are arranged with prescribed spacings and the plurality of curved surface members do not have a concave portion, the curved surface member has a convex curved surface in which at least a convex curved part having a surface shape of a spherical surface or an aspherical surface exists and the convex curved part is in a state of protruding more on a side of the vibrating surface than a portion other than the convex curved part does, and the convex curved surface is held in a state of facing the vibrating surface in such a manner that at least part of first sound waves that are sound waves that are applied from the ultrasonic application mechanism and that have not experienced reflection arrive at the convex curved part of the convex curved surface.

2. An ultrasonic cleaning equipment comprising:

a treatment tank that stores a cleaning liquid that cleans an object to be cleaned and in which the object to be cleaned is immersed;

an ultrasonic application mechanism that applies ultrasonic waves to the cleaning liquid retained in an interior of the treatment tank; and a curved surface member that is located in a range defined by an angle of inclination from a perpendicular direction in an end portion of a vibrating surface of the ultrasonic application mechanism to an outside with respect to the vibrating surface and that is held on a wall surface and/or a bottom surface of the treatment tank, wherein a plurality of the curved surface members are arranged with prescribed spacings and the plurality of curved surface members do not have a concave portion, the curved surface member has a convex curved surface in which at least a convex curved part having a surface shape of a spherical surface or an aspherical surface exists and the convex curved part is in a state of protruding more on a side of the vibrating surface than a portion other than the convex curved part does, and the convex curved surface is held in a state of facing the vibrating surface in such a manner that at least part of first sound waves that are sound waves that are applied from the ultrasonic application mechanism and that have not experienced reflection arrive at the convex curved part of the convex curved surface.

3. The ultrasonic cleaning equipment according to claim 1, wherein a maximum height H of the convex curved part in the convex curved surface satisfies a relation of $\lambda/2<H$, where a wavelength of the ultrasonic wave is denoted by $\lambda$.

4. The ultrasonic cleaning equipment according to claim 1, wherein a magnitude of the angle of inclination is more than or equal to 0 degrees and less than or equal to 30 degrees.

5. The ultrasonic cleaning equipment according to claim 1, wherein the convex curved part of the curved surface member has an area ratio of more than or equal to 30% to a total area of the curved surface member located in the range prescribed on the basis of the vibrating surface.

6. The ultrasonic cleaning equipment according to claim 1, wherein the convex curved part of the curved surface member has an area ratio of more than or equal to 1% and less than or equal to 80% to a total surface area of the wall surface and/or the bottom surface of the treatment tank located in the range prescribed on the basis of the vibrating surface.

7. The ultrasonic cleaning equipment according to claim 1, wherein the curved surface member, and the wall surface and/or the bottom surface on which the curved surface member is placed do not have a concave portion.

8. The ultrasonic cleaning equipment according to claim 1, wherein a separation distance L between adjacent ones of the plurality of curved surface members satisfies a relation of $3H<L$ for a maximum height H of the convex curved part of the curved surface member.

9. The ultrasonic cleaning equipment according to claim 1, wherein a separation distance D between the vibrating surface and a position that gives a maximum height of the convex curved part in the convex curved surface in the curved surface member is more than or equal to 5 cm and less than or equal to 250 cm.

10. The ultrasonic cleaning equipment according to claim 1, wherein the curved surface member is a curved surface member made of a material with an acoustic impedance of more than or equal to $1\times10^7$ [$kg\cdot m^{-2}\cdot sec^{-1}$] and less than or equal to $2\times10^8$ [$kg\cdot m^{-2}\cdot sec^{-1}$].

11. The ultrasonic cleaning equipment according to claim 1, wherein the ultrasonic application mechanism selects a frequency of the ultrasonic wave from a frequency band of 20 kHz to 200 kHz.

12. The ultrasonic cleaning equipment according to claim 1, wherein the ultrasonic application mechanism applies ultrasonic waves to the cleaning liquid while sweeping frequency in a range of ±0.1 kHz to ±10 kHz about a selected ultrasonic frequency.

13. The ultrasonic cleaning equipment according to claim 1, wherein a reflector that reflects ultrasonic waves is further provided between the curved surface member and the wall surface or the bottom surface of the treatment tank on which the curved surface member is held.

14. The ultrasonic cleaning equipment according to claim 1, wherein the treatment tank is configured by that a depth from a surface of the cleaning liquid of 2 m or less and a total length of 25 m or less.

15. The ultrasonic cleaning equipment according to claim 1, further comprising:

a dissolved gas control mechanism that controls the amount of dissolved gas in the cleaning liquid retained in the treatment tank.

16. The ultrasonic cleaning equipment according to claim 15, wherein the dissolved gas control mechanism makes control so that the amount of dissolved gas is 1% to 50% of the saturation amount of dissolved gas in the cleaning liquid.

17. The ultrasonic cleaning equipment according to claim 1, further comprising:

a fine bubble supply mechanism that supplies fine bubbles each having an average air bubble diameter of less than or equal to 100 μm into the cleaning liquid retained in the treatment tank.

18. The ultrasonic cleaning equipment according to claim 17, wherein the fine bubble supply mechanism supplies fine bubbles each having an average air bubble diameter of 0.01 μm to 100 μm in such a manner that the total amount of air bubbles is $10^3$/mL to $10^{10}$/mL.

19. The ultrasonic cleaning equipment according to claim 17, wherein the fine bubble supply mechanism supplies the fine bubbles in such a manner that, in the cleaning liquid, a proportion of the number of fine bubbles each having an air bubble diameter less than or equal to a frequency resonance diameter that is a diameter resonating with a frequency of the ultrasonic wave is more than or equal to 70% of the number of all the fine bubbles existing in the cleaning liquid.

* * * * *